US007219636B2

(12) United States Patent
Sawada

(10) Patent No.: US 7,219,636 B2
(45) Date of Patent: May 22, 2007

(54) VARIABLE VALVE TIMING CONTROL SYSTEM OF INTERNAL COMBUSTION ENGINE

(75) Inventor: Takanori Sawada, Kanagawa (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/133,263

(22) Filed: May 20, 2005

(65) Prior Publication Data

US 2005/0257762 A1 Nov. 24, 2005

(30) Foreign Application Priority Data

May 20, 2004 (JP) ..... 2004-149890

(51) Int. Cl.
*F01L 1/34* (2006.01)

(52) U.S. Cl. ..... 123/90.17; 123/90.15; 123/90.31

(58) Field of Classification Search ..... 123/90.17, 123/90.15, 90.31, 90.16
See application file for complete search history.

(56) References Cited

U.S. PATENT DOCUMENTS 3,765,727 A * 10/1973 Santangelo et al. ..... 406/153
5,628,286 A * 5/1997 Kato et al. ..... 123/90.15
6,062,182 A * 5/2000 Ogawa ..... 123/90.17
6,062,183 A * 5/2000 Sato et al. ..... 123/90.17
6,182,623 B1 * 2/2001 Sugie et al. ..... 123/90.17
6,318,332 B1 * 11/2001 Kern et al. ..... 123/196 S
6,345,595 B2 2/2002 Yamada
2001/0022164 A1 * 9/2001 Ogawa ..... 123/90.16
2002/0026914 A1 * 3/2002 Maeyama et al. ..... 123/90.15
2003/0010303 A1 * 1/2003 Kanada et al. ..... 123/90.17
2003/0188704 A1 * 10/2003 Aimone ..... 123/90.17
2003/0230268 A1 * 12/2003 Simpson et al. ..... 123/90.17

FOREIGN PATENT DOCUMENTS

DE 101 01 938 A1 8/2001
JP 2001-271616 A 10/2001

* cited by examiner

*Primary Examiner*—Thomas Denion
*Assistant Examiner*—Zelalem Eshete
(74) *Attorney, Agent, or Firm*—Foley & Lardner LLP

(57) ABSTRACT

A variable valve timing control system of an internal combustion engine includes a hydraulically-operated phase converter disposed between a sprocket and a camshaft, and having a phase-advance hydraulic chamber and a phase-retard hydraulic chamber for changing an angular phase of the camshaft relative to the sprocket. An electric pump is provided to supply working fluid selectively to one of the hydraulic chambers via a directional control valve. Also provided is a check valve disposed in a discharge line of the pump for permitting flow in a direction that the working fluid flows from the pump to the directional control valve and preventing any flow in the opposite direction, so as to prevent a pulse pressure arising from alternating torque exerted on the camshaft from being transmitted from either one of the hydraulic chambers via the discharge line to a discharge port of the pump.

7 Claims, 10 Drawing Sheets

VARIABLE VALVE TIMING CONTROL SYSTEM OF INTERNAL COMBUSTION ENGINE

TECHNICAL FIELD

The present invention relates to a variable valve timing control system employing a hydraulically-operated phase converter capable of varying a relative phase of a camshaft to a crankshaft of an internal combustion engine by supplying working fluid (hydraulic pressure) selectively to either one of a phase-advance hydraulic chamber and a phase-retard hydraulic chamber, for variably adjusting an open-and-closure timing of an engine valve depending on an engine operating condition.

BACKGROUND ART

In recent years, there have been proposed and developed various variable valve timing control systems each employing a phase converter, such as a hydraulically-operated vane-type timing variator, a hydraulically-operated helical-gear-type timing variator, and the like. A hydraulically-operated vane-type timing variator has been disclosed in Japanese Patent Provisional Publication No. 2001-271616 (hereinafter is referred to as "JP2001-271616"), corresponding to German patent application No. 101 01 938 and also corresponding to U.S. Pat. No. 6,345,595, issued on Feb. 12, 2002 and assigned to the assignee of the present invention. In the hydraulically-operated vane-type variable valve timing control system disclosed in JP2001-271616, a vane member is fixedly connected to a camshaft end and rotatably enclosed in a cylindrical housing of a timing pulley whose opening ends are enclosed with front and rear covers. A phase-advance hydraulic chamber and a phase-retard hydraulic chamber are defined between diametrically-opposing partition walls and two blades of the vane member. The hydraulically-operated phase converter operates to vary a relative angular phase between the camshaft and the timing pulley (engine crankshaft) by supplying hydraulic pressure discharged from a reversible pump selectively to either one of the phase-advance hydraulic chamber and the phase-retard hydraulic chamber by switching one of a normal-rotational direction and a reverse-rotational direction of the reversible pump to the other, for variably adjusting a valve open timing and/or a valve closure timing of the engine valve depending on an engine operating condition.

SUMMARY OF THE INVENTION

However, in the system disclosed in JP2001-271616, the phase-advance hydraulic chamber is connected directly to a first port of two ports of the reversible pump via a first fluid line. In a similar manner, the phase-retard hydraulic chamber is connected directly to the second port of the reversible pump via a second fluid line. As is generally known, a comparatively large magnitude of alternating torque is exerted on the camshaft owing to a spring force of a valve spring for each engine valve and a reaction force resulting from each valve lifting during operation of the engine. Due to the alternating torque, a pulse pressure is applied to the working fluid in each of the phase-advance and phase-retard hydraulic chambers. There is an increased tendency for the pulse pressure, arising from alternating torque exerted on the camshaft, to be transmitted from the phase-advance and phase-retard hydraulic chambers through the first and second fluid lines to the respective ports of the reversible pump.

The pulsating pressure serves as an undesirable load (in other words, undesirable energy loss) carried on the motor shaft of the electric motor of the reversible pump. Such an undesirable load means the necessity of an increased torque capacity of the electric motor of the reversible pump, in other words, large-sizing of the system, or higher system costs. It would be desirable to provide a means by which the pulse pressure, arising from alternating torque exerted on the camshaft, may be avoided from acting as a load carried on the motor shaft of the electric motor of the reversible pump.

Accordingly, it is an object of the invention to provide a variable valve timing control system employing a hydraulically-operated phase converter, capable of preventing a pulse pressure, arising from alternating torque exerted on a camshaft, from being transmitted from either one of phase-advance and phase-retard hydraulic chambers to a first port of two ports of a reversible pump as a load carried on a motor shaft of the pump, and promoting the outflow of working fluid from the other hydraulic chamber to the second port by the pulse pressure so that the promoted outflow serves as an assistance force (an assistive drive source for the pump).

In order to accomplish the aforementioned and other objects of the present invention, a variable valve timing control system of an internal combustion engine comprises a rotary member adapted to be driven in synchronization with rotation of an engine crankshaft, and rotatably supported on a camshaft to permit relative rotation of the camshaft to the rotary member, a hydraulically-operated phase converter disposed between the rotary member and the camshaft, and having a phase-advance hydraulic chamber and a phase-retard hydraulic chamber for changing an angular phase of the camshaft relative to the rotary member, an electric pump that supplies working fluid to the phase-advance hydraulic chamber and the phase-retard hydraulic chamber through a phase-advance hydraulic line connected to the phase-advance hydraulic chamber and a phase-retard hydraulic line connected to the phase-retard hydraulic chamber, a directional control valve disposed between a first pair of fluid lines including a discharge line and an induction line of the pump and a second pair of fluid lines including the phase-advance hydraulic line and the phase-retard hydraulic line, for determining a path through which the working fluid is directed from the discharge line to a first one of the phase-advance hydraulic line and the phase-retard hydraulic line and simultaneously determining a path through which the working fluid is directed from the second hydraulic line to the induction line, a control unit configured to be electronically connected to at least the directional control valve, for controlling the directional control valve depending on an engine operating condition, and a check valve disposed in the discharge line for permitting flow in a direction that the working fluid flows from the pump to the directional control valve and preventing any flow in the opposite direction.

According to another aspect of the invention, a variable valve timing control system of an internal combustion engine comprises a rotary member adapted to be driven in synchronization with rotation of an engine crankshaft, and rotatably supported on a camshaft to permit relative rotation of the camshaft to the rotary member, a hydraulically-operated phase converter disposed between the rotary member and the camshaft, and having a phase-advance hydraulic chamber and a phase-retard hydraulic chamber for changing an angular phase of the camshaft relative to the rotary member, an electric pump that supplies working fluid to the phase-advance hydraulic chamber and the phase-retard hydraulic chamber through a phase-advance hydraulic line connected to the phase-advance hydraulic chamber and a phase-retard hydraulic line connected to the phase-retard hydraulic chamber, an electromagnetic solenoid-operated directional control valve disposed between a first pair of fluid lines including a discharge line and an induction line of the pump and a second pair of fluid lines including the phase-advance hydraulic line and the phase-retard hydraulic line, for determining a path through which the working fluid is directed from the discharge line to a first one of the phase-advance hydraulic line and the phase-retard hydraulic line and simultaneously determining a path through which the working fluid is directed from the second hydraulic line to the induction line, a control unit configured to be electronically connected to at least the solenoid-operated directional control valve, for controlling the solenoid-operated directional control valve depending on an engine operating condition, a bypass line intercommunicating the discharge line and the induction line, and a bypass check valve disposed in the bypass line for permitting flow in a direction that the working fluid flows from the induction line via the bypass line to the discharge line and preventing any flow in the opposite direction.

According to a further aspect of the invention, a variable valve timing control system of an internal combustion engine comprises a rotary member adapted to be driven in synchronization with rotation of an engine crankshaft, and rotatably supported on a camshaft to permit relative rotation of the camshaft to the rotary member, a hydraulically-operated phase converter disposed between the rotary member and the camshaft, and having a phase-advance hydraulic chamber and a phase-retard hydraulic chamber for changing an angular phase of the camshaft relative to the rotary member, an electric pump that supplies working fluid to the phase-advance hydraulic chamber and the phase-retard hydraulic chamber through a phase-advance hydraulic line connected to the phase-advance hydraulic chamber and a phase-retard hydraulic line connected to the phase-retard hydraulic chamber, an electromagnetic solenoid-operated directional control valve disposed between a first pair of fluid lines including a discharge line and an induction line of the pump and a second pair of fluid lines including the phase-advance hydraulic line and the phase-retard hydraulic line, for determining a path through which the working fluid is directed from the discharge line to a first one of the phase-advance hydraulic line and the phase-retard hydraulic line and simultaneously determining a path through which the working fluid is directed from the second hydraulic line to the induction line, a bypass line intercommunicating the discharge line and the induction line, a control unit configured to be electronically connected to at least the solenoid-operated directional control valve, for controlling the solenoid-operated directional control valve depending on an engine operating condition, the control unit comprising a pump-failure detection section that detects a failure in the pump, and the control unit executes a fail-safe operating mode when the failure in the pump is detected by the pump-failure detection section, for creating a phase-control assistance force needed to supply the working fluid through the bypass line selectively to either one of the phase-advance hydraulic chamber and the phase-retard hydraulic chamber by a pulse pressure arising from alternating torque exerted on the camshaft, by controlling the solenoid-operated directional control valve without using the pump.

The other objects and features of this invention will become understood from the following description with reference to the accompanying drawings.

DESCRIPTION OF THE PREFERRED EMBODIMENTS

Figure 1:
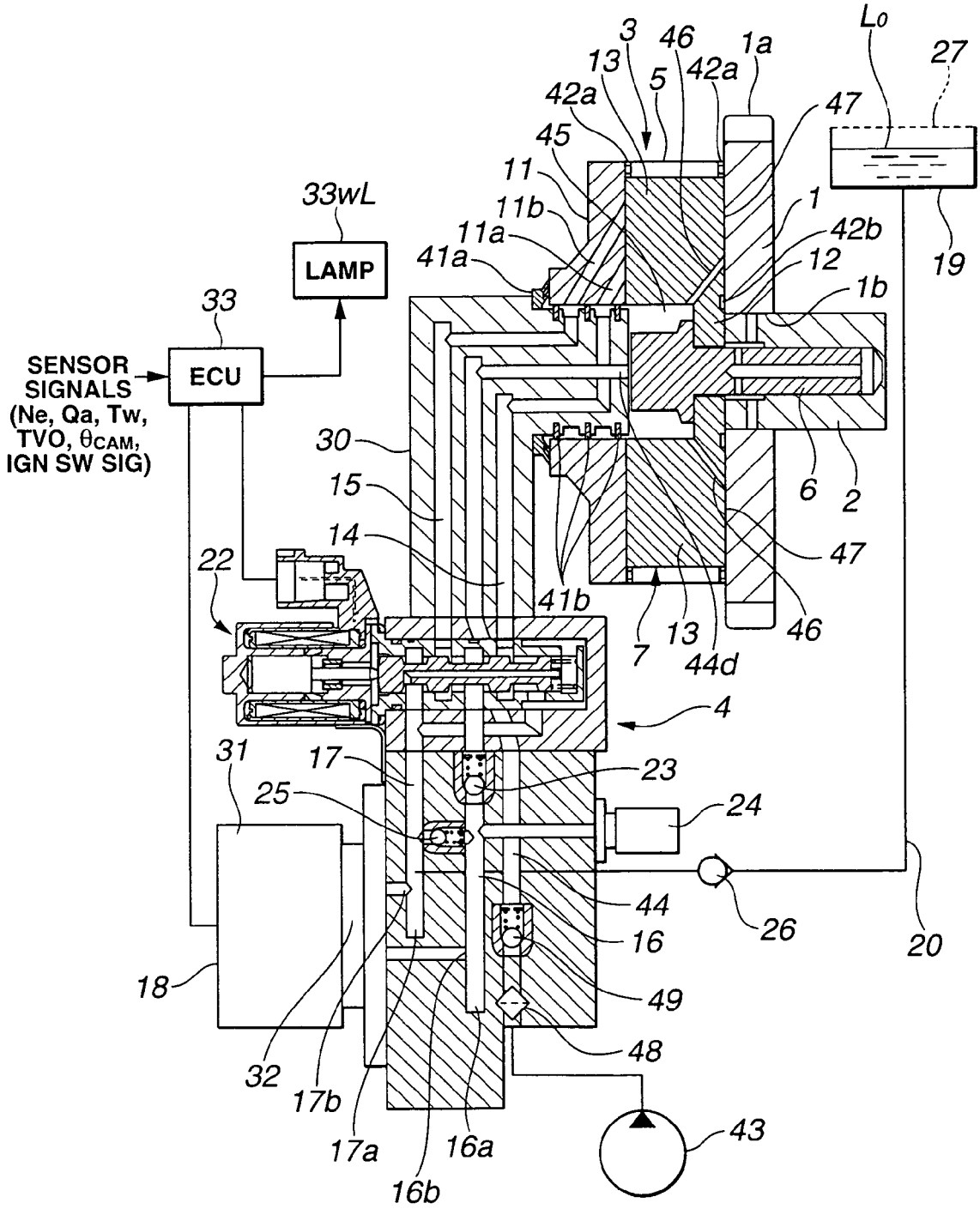
FIG. 1 is a system block diagram illustrating an embodiment of an automotive variable valve timing control system with a hydraulically-operated phase converter, cross-sectioned.
Figure 2:
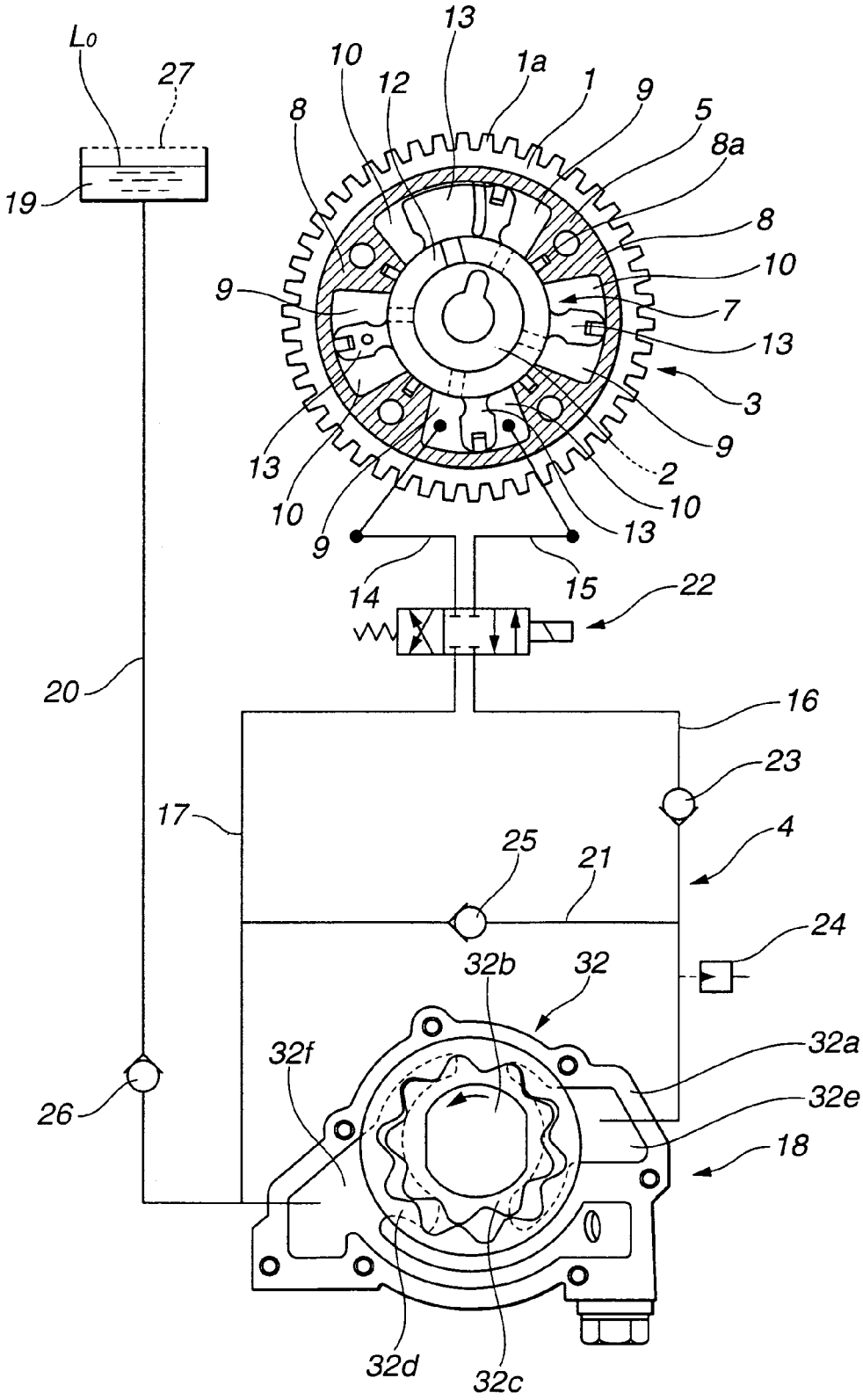
FIG. 2 is hydraulic circuit diagram illustrating a hydraulic circuit of the variable valve timing control system of the embodiment.

Referring now to the drawings, particularly to FIGS. 1 and 2, the hydraulically-operated phase converter equipped variable valve timing control system of the embodiment is exemplified in an automotive vehicle with a vane-type timing variator.

As shown in FIG. 1, the variable valve timing control system of the embodiment is comprised of a disc-shaped sprocket 1, a camshaft 2, a phase converter 3, and a hydraulic circuit 4. Sprocket 1 serves as a rotary member, which is driven in synchronism with rotation of an engine crankshaft (not shown) via a timing chain. Camshaft 2 is provided to operate engine valves such that relative rotation between sprocket 1 and camshaft 2 is permitted. Phase converter 3 is disposed between sprocket 1 and camshaft 2 for converting or changing an angular phase of camshaft 2 relative to sprocket 1. Hydraulic circuit 4 is connected to phase converter 3 to hydraulically operate phase converter 3.

Sprocket 1 has an outer toothed portion 1*a* formed on its outer periphery and in meshed-engagement with the timing chain, and a central bore 1*b*. Sprocket 1 is rotatably supported on the camshaft end by loosely fitting central bore 1*b* of sprocket 1 onto the outer peripheral surface of camshaft 2 in such a manner as to permit relative rotation of camshaft 2 to sprocket 1. Phase converter 3 is located on the front end (the left sidewall of sprocket 1 in FIG. 1).

Camshaft 2 is rotatably supported on a cylinder head (not shown) by means of cam bearings. Camshaft 2 has a series of cams formed integral with the camshaft, for opening and closing engine valves via valve lifters (not shown).

Phase converter 3 includes a substantially cylindrical phase-converter housing 5 fixedly connected to sprocket 1 and a vane member 7 fixedly connected to the camshaft end. In the shown embodiment, housing 5 is bolted to the front end of sprocket 1, whereas vane member 7 is bolted to the front end of camshaft 2 with a vane mounting bolt 6 by tightening the bolt, so that vane member 7 is rotatably housed in the cylindrical housing 5. In lieu thereof, in order to change a relative phase of camshaft 2 to sprocket 1, vane member 7 is fixedly connected to the front end of sprocket 1 (the rotary member), whereas housing 5 is fixedly connected to the front end of camshaft 2. As best seen in FIG. 2, housing 5 is integrally formed with four partition wall portions 8, 8, 8, and 8 each protruding radially inwards from the inner periphery of the cylindrical housing and has a frusto-conical shape in lateral cross section. Four phase-retard hydraulic chambers 9, 9, 9, and 9, and four phase-advance hydraulic chambers 10, 10, 10, and 10 are defined by the four partition walls 8 and vane member 7. Vane member 7 and four partition wall portions 8 are cooperated with each other to partition the internal space of housing 5 into the first group of phase-advance hydraulic chambers 10 and the second group of phase-retard hydraulic chambers 9. Housing 5 is comprised of a porous housing, which is made of a porous sintered metal member such as sintered alloy materials. As can be seen from the cross section of FIG. 1, the rear opening end of the cylindrical housing 5 is enclosed by the front end face of sprocket 1, while the front opening end of housing 5 is hermetically covered by a disc-shaped front cover 11 by tightening four bolts. On the other hand, vane member 7 is comprised of a substantially annular ring-shaped vane rotor 12 and four radially-extending vanes or blades 13, 13, 13, and 13. Vane rotor 12 has an axially-extending central bore into which vane mounting bolt 6 is inserted for bolting vane member 7 to the front end of camshaft 2 by axially tightening the vane mounting bolt. Four blades 13 are formed integral with vane rotor 12, so that four blades 13 are circumferentially spaced apart from each other, and that extend radially outwards from the outer periphery of vane rotor 12. The two adjacent blades 13 and 13 are circumferentially spaced apart from each other by approximately 90 degrees. Each of four blades 13, 13, 13, and 13 is disposed in an internal space defined between the two adjacent partition wall portions 8 and 8. As best seen in FIG. 2, four seals 8*a*, 8*a*, 8*a*, and 8*a* are fitted into respective seal grooves formed in apexes of four partition wall portions 8, 8, 8, and 8. Thus, vane rotor 12 is rotatably slidably supported by means of four seals 8*a*. In a similar manner, four apex seals (not numbered) are fitted into respective seal grooves formed in apexes of four blades 13, 13, 13, and 13, so that each blade 13 is slidable along the inner peripheral wall surface of housing 5. As can be seen from the cross section of FIG. 2, phase-retard hydraulic chamber 9 is defined between the first sidewall of each of blades 13 facing in the normal-rotational direction of blades 13 and the first sidewall of each of partition wall portions 8 opposing the first sidewall of blade 13. Similarly, phase-advance hydraulic chamber 10 is defined between the second sidewall of each blade 13 facing in the reverse-rotational direction of blades 13 and the second sidewall of each partition wall portion 8 opposing the second sidewall of blade 13. Four phase-retard hydraulic chambers 9, 9, 9, and 9 are communicated with each other by means of a first group of communication holes or passages formed in vane rotor 12 and crossed to each other. Four phase-advance hydraulic chambers 10, 10, 10, and 10 are communicated with each other by means of a second group of communication holes or passages formed in vane rotor 12 and crossed to each other.

As can be appreciated from the hydraulic circuit diagram of FIG. 2, hydraulic circuit 4 is formed as a closed-loop hydraulic circuit. Hydraulic circuit 4 functions to supply hydraulic pressure (working fluid) selectively to either one of phase-retard hydraulic chamber 9 and phase-advance hydraulic chamber 10, and also functions to exhaust the hydraulic pressure (working fluid) from the other hydraulic chamber. Returning to FIG. 1, the closed-loop hydraulic circuit 4 is comprised of a phase-retard hydraulic line 14, a phase-advance hydraulic line 15, a discharge line 16, a suction line (or an induction line) 17, an electric motor-driven oil pump 18, a hydraulic supply line 20, a bypass line (or a communicating line) 21, and an electromagnetic directional control valve 22. Phase-retard hydraulic line 14 is provided to supply or exhaust hydraulic pressure to or from a specified one of four phase-retard hydraulic chambers 9. Phase-advance hydraulic line 15 is provided to supply or exhaust hydraulic pressure to or from a specified one of four phase-advance hydraulic chambers 10. As described later, in the system of the embodiment, pump 18 is constructed by a non-reversible pump having an outlet port 32*e* (see FIG. 2) connected to the upstream end of discharge line 16 and an inlet port 32*f* (see FIG. 2) connected to the downstream end of induction line 17. As shown in FIGS. 1 and 2, supply line 20 is connected at its upstream end to a reservoir 19, and connected at its downstream end to induction line 17. Bypass line 21 is disposed between discharge line 16 and induction line 17 so as to directly intercommunicate them not through pump 18. Directional control valve 22 is disposed between a first pair of fluid lines including the phase-advance and phase-retard hydraulic lines 15 and 14 and a second pair of fluid lines including the discharge and induction lines 16 and 17, for determining the path through which a fluid traverses within a given circuit. As seen from the cross section of FIG. 1, the two hydraulic lines 14 and 15 are formed in a fluid-line structural block 30 fixedly mounted on the cylinder head, and arranged in parallel with each other. One end of phase-retard hydraulic line 14 is connected to phase-retard hydraulic chamber 9 via a first inclined line 11*a* formed in front cover 11. In a similar manner, one end of phase-advance hydraulic line 15 is connected to phase-advance hydraulic chamber 10 via a second inclined line 11*b* formed in front cover 11 and arranged in parallel with the first inclined line 11*a*. The other end of phase-retard hydraulic line 14 is connected to a first port 35*a* (described later in reference to FIGS. 6A–6C) of directional control valve 22, whereas the other end of phase-advance hydraulic line 15 is connected to a second port 35*b* (described later in reference to FIGS. 6A–6C) of directional control valve 22. As clearly shown in FIG. 1, each of discharge line 16 and induction line 17 is comprised of a comparatively long, vertically-extending oil line segment and a comparatively short, horizontally-extending oil line segment. The junction (or the substantially L-shaped fluid-line portion) 16*b* of the vertically-extending oil line segment and the horizontally-extending oil line segment both constructing discharge line 16 is located in the vicinity of pump 18. The junction (or the substantially L-shaped fluid-line portion) 17*b* of the vertically-extending oil line segment and the horizontally-extending oil line segment both constructing induction line 17 is also located in the vicinity of pump 18. A short vertically-extended bore 16*a* is formed in fluid-line structural block 30 in such a manner as to slightly extend downwards in a direction of acceleration of gravity from the junction 16*b* of the vertically-extending oil line segment and the horizontally-extending oil line segment both constructing discharge line 16. In a similar manner, a short vertically-extended bore 17*a* is formed in fluid-line structural block 30 in such a manner as to slightly extend downwards in the direction of acceleration of gravity from the junction 17*b* of the vertically-extending oil line segment and the horizontally-extending oil line segment both constructing induction line 17. Each of vertical bores 16*a* and 17*a* is closed at its lower end, and serves as a contaminant trap by which dust, dirt, or other contaminants, such as metallic debris, mixed in working fluid (oil), can be removed and captured or trapped by the aid of deadweights of the contaminants themselves. By virtue of the contaminant-capturing vertical bores 16*a* and 17*a*, it is possible to prevent dust, dirt, or other contaminants such as metallic debris from entering directional control valve 4 (or phase converter 3). This contributes to a less possibility of the directional control valve sticking due to contaminants, and also enhances the reliability of operation of phase converter 3. In the shown embodiment, the two contaminant-capturing vertical bores 16*a* and 17*a* are formed at the respective junctions 16*b* and 17*b*. At least one contaminant-capturing vertical bore (16*a* or 17*a*) may be formed.

In the system of the embodiment shown in FIGS. 1–2, a one-way check valve 23 is disposed in discharge line 16, for permitting only the working-fluid flow from discharge port 32*e* of pump 18 to a third port 35*c* (described later in reference to FIGS. 6A–6C) of directional control valve 22. As clearly shown in FIGS. 1–2, a pressure switch 24 (a pressure sensor, a pressure detector, or pressure detection means) is connected to or provided in discharge line 16 and located near the discharge port of pump 18, for detecting or sensing a change in hydraulic pressure in discharge line 16. Pressure switch 24 closes electrical switching element when a predetermined pressure point is reached, so as to generate a pressure switch signal indicating that the hydraulic pressure in discharge line 16 is higher than the predetermined pressure point. A bypass check valve 25 is disposed in bypass line 21 in such a manner as to permit only the working-fluid flow from induction line 17 to discharge line 16. In addition to check valves 23 and 25, a reservoir check valve 26 is disposed in supply line 20 for permitting only the fluid flow from reservoir 19 to induction line 17. An oil-purifying filter or strainer 27 is provided at the upper opening end of reservoir 19, and located at a higher level than an oil level Lo of reservoir 19 in a direction of acceleration of gravity. Also, the level of installation of the reservoir 19 itself is set to be higher than the level of installation of the hydraulically-operated phase converter 3 in the direction of acceleration of gravity.

As best seen in FIG. 2, electric motor-driven pump 18 is comprised of a non-reversible electric motor 31 and a trochoid pump 32 driven by motor 31. Motor 31 is designed to rotate in only one rotational direction. Motor 31 is controlled responsively to a control signal (or a control current) from a controller, particularly, an electronic control unit (ECU) 33. Trochoid pump 32 is comprised of a pump housing 32*a*, a pump shaft 32*b*, and inner and outer rotors 32*c* and 32*d*. Pump shaft 32*b* is fixedly connected to the motor shaft of motor 31 so that the pump shaft rotates in synchronism with the rotation of the motor shaft. Inner rotor 32*c* is fitted onto pump shaft 32*b* so that inner rotor 32*c* is driven by pump shaft 32*b*. Inner rotor 32*c* has an outer toothed portion, whereas outer rotor 32*d* has an inner toothed portion in meshed-engagement with the outer toothed portion of inner rotor 32*c*. Trochoid pump 32 has outlet and inlet ports 32*e* and 32*f* formed in pump housing 32*a*. Pump outlet port 32*e* communicates with discharge line 16, whereas pump inlet port 32*f* communicates with induction line 17. Electric motor-driven pump 18 (trochoid pump 32) is properly driven and shifted from an inoperative state to an operative state, when an open-and-closure timing of the engine valve, for example, an intake valve open timing, often abbreviated to "IVO", and an intake valve closure timing, often abbreviated to "IVC", must be phase-changed depending on an engine operating condition.

Figure 6A:
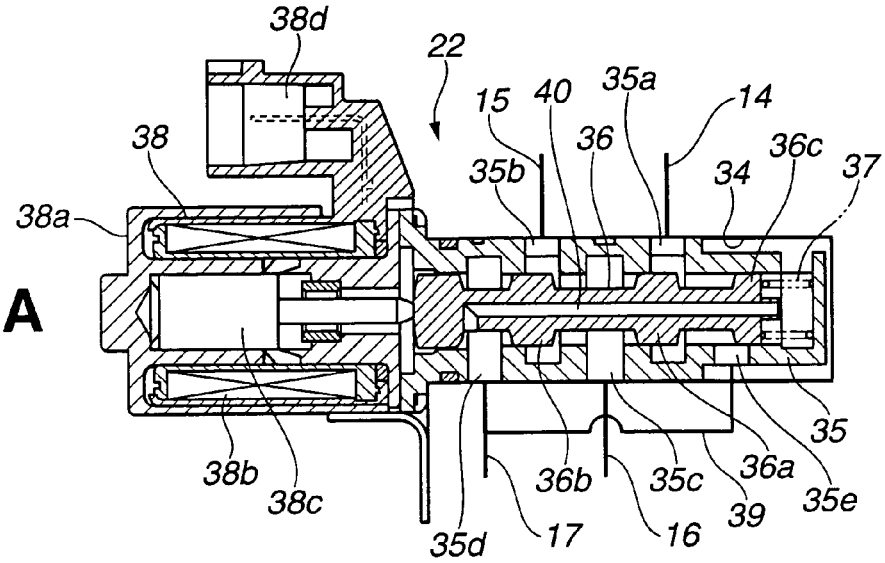
FIG. 6A is a longitudinal cross-sectional view explaining the operation of an electromagnetic directional control valve incorporated in the variable valve timing control system of the embodiment, during the phase-advance operating mode.
Figure 6B:
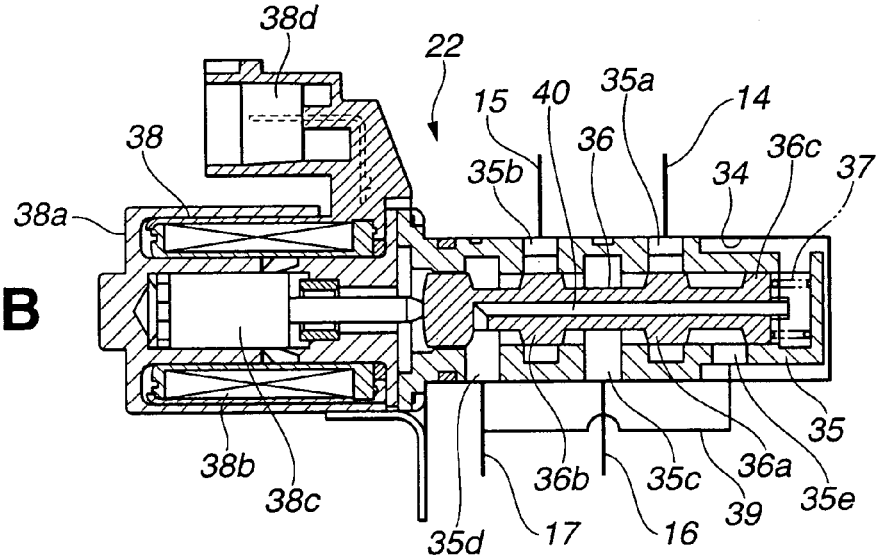
FIG. 6B is a longitudinal cross-sectional view explaining the operation of the electromagnetic directional control valve, during the phase-hold operating mode.
Figure 6C:
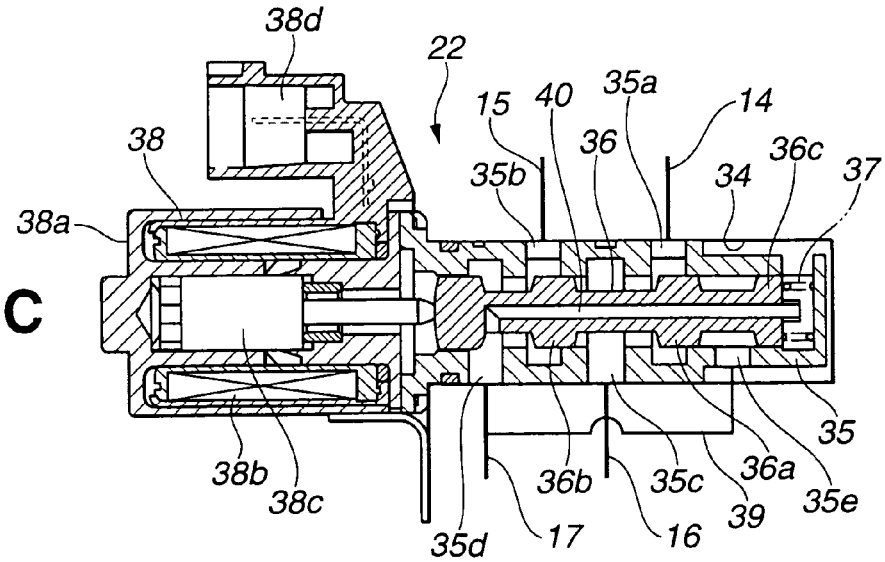
FIG. 6C is a longitudinal cross-sectional view explaining the operation of the electromagnetic directional control valve, during the phase-retard operating mode.

As best seen in FIGS. 6A–6C, electromagnetic directional control valve 22 is constructed by a single solenoid-actuated, four-way, three-position directional control valve. In more detail, directional control valve 22 is comprised of a valve housing 35, a slidable valve spool 36, a valve spring 37, and an electromagnetic solenoid 38. Valve housing 35 is closed at one end and substantially cylindrical in shape. Valve housing 35 is fitted into a valve mounting hole 34 formed in the cylinder head. Spool 36 has at least three lands 36*a*, 36*b*, and 36*c* (described later) formed integral with the valve spool body. Each of the lands is loosely fitted to the cylindrical bore formed in valve housing 35, so that spool 36 is axially slidable in valve housing 35. When solenoid 38 is energized, solenoid 38 acts to attract or move the spool rightwards (viewing FIGS. 6A–6C) against the spring force of valve spring 37. Valve housing 35 has five ports, namely the first port 35*a* connected to the other end of phase-retard hydraulic line 14, the second port 35*b* connected to the other end of phase-advance hydraulic line 15, the third port 35*c* connected to the downstream end of discharge line 16, the fourth port 35*d* connected to the upstream end of induction line 17, and the fifth port (or a drain port) 35*e* connected via a drain line 39 to the upstream end of induction line 17. The first, second, third, fourth, and fifth ports 35*a*, 35*b*, 35*c*, 35*d*, and 35*e* are formed in valve housing 5 as radial bores extending radially with respect to the axis of spool 36. Drain port (the fifth port) 35*e* is located near the bottom of valve housing 35.

Spool 36 is formed with the first, second, and third lands 36*a*, 36*b*, and 36*c* axially spaced from each other, for properly opening and closing the ports 35*a*–35*e*. Spool 36 is also formed with a communicating bore 40 comprised of a comparatively long, axially-extending central bore portion and a comparatively short, radial bore portion. The radial bore portion of communicating bore 40 communicates the fourth port 35*d* connected to induction line 17, whereas the axial bore portion of communicating bore 40 communicates a spring chamber of valve spring 37. The spring chamber of valve spring 37 is opened to the atmosphere. By virtue of communicating bore 40 intercommunicating the fourth port 35*d* connected to induction line 17 and the spring chamber opened to the atmosphere, it is possible to prevent a resistance to sliding movement of spool 36 from being generated or developed during operation of directional control valve 22.

Electromagnetic solenoid 38 includes a solenoid housing 38*a*, an electrically energized coil 38*b*, and a plunger (or an armature) 38*c*. As clearly shown in FIGS. 6A–6C, solenoid housing 38*a* has a cylindrical bore closed at one end. Coil 38*b* is installed in the cylindrical bore of solenoid housing 38*a* and arranged annularly along the inner periphery of solenoid housing 38*a*, so that plunger 38*c* is axially slidable in the coil. When coil 38*b* is energized, it creates an electromagnetic force that repels plunger 38*c*, such that plunger 38*c* comes out of the solenoid housing. Coil 38*b* of electromagnetic solenoid 38 is electrically connected through a connector 38*d* to the output interface of ECU 33, so that the axial position of spool 36 is controlled in response to a command signal (or a control pulse signal) generated from the output interface of ECU 33 to coil 38*b*. Concretely, the axial position of spool 36 is controlled by way of pulse-width modulated (PWM) control for the exciting current (or the control pulse signal) applied to coil 38*b* of electromagnetic solenoid 38. For instance, when the pulse-width modulated signal of a predetermined high duty ratio such as "100%" is applied to coil 38*b*, as shown in FIG. 6C, spool 36 slides axially rightwards against the spring force of valve spring 37 and is held at its maximum actuated position (or the rightmost position). With spool 36 held at the maximum actuated position, fluid communication between discharge line 16 and phase-retard hydraulic line 14 is established and simultaneously fluid communication between induction line 17 and phase-advance hydraulic line 15 is established. When the pulse-width modulated signal of a predetermined middle duty ratio such as an intermediate value, which is substantially midway between "100%" and "0%", is applied to coil 38*b*, the spring force of valve spring 37 and the repulsion force created by coil 38*b* are suitably balanced to each other and thus spool 36 is held at an intermediate axial position (see FIG. 6B). With spool 36 held at the intermediate axial position shown in FIG. 6B, the first port 35*a* is closed or blocked by the first land 36*a*, and simultaneously the second port 35*b* is closed or blocked by the second land 36*b*, and thus directional control valve 22 is kept at the shutoff position and there is no fluid flow through directional control valve 22. In contrast to the above, when the pulse-width modulated signal of a predetermined low duty ratio such as "0%" is applied to coil 38*b*, in other words, there is no exciting current applied to coil 38*b*, as shown in FIG. 6A, spool 36 is held at its spring-offset position (or the leftmost position). With spool 36 held at the spring-offset position, fluid communication between discharge line 16 and phase-advance hydraulic line 15 is established and simultaneously fluid communication between induction line 17 (or drain line 39) and phase-retard hydraulic line 14 is established.

As can be seen from the cross section of FIG. 1, for the purpose of oil-leakage prevention, a plurality of oil seals are provided. Concretely, oil seals 41*a*, 41*b*, 41*b*, and 41*b* are placed at the fitting portion between front cover 11 and fluid-line structural block 30. A pair of oil seals 42*a* and 42*a* are placed at the fitting portions between the left-hand sidewall of phase-converter housing 5 and front cover 11 and between the right-hand sidewall of phase-converter housing 5 and the left-hand sidewall of sprocket 1. An oil seal 42*b* is also placed at the fitting portion between the right-hand sidewall of vane rotor 12 and the left-hand sidewall of sprocket 1.

In the system of the embodiment shown in FIG. 1, an oil pump 43 that supplies moving engine parts with lubricating oil, also serves as a supplementary working-fluid source for the hydraulically-operated phase converter 3. In addition to electric motor-driven oil pump 18, oil pump 43 constructs a part of hydraulic circuit 4. Thus, by the use of oil pump 43 as well as electric motor-driven oil pump 18, if needed, a comparatively small amount of lubricating oil (working fluid) discharged from oil pump 43 (the supplementary working-fluid source) can be supplied to each of phase-retard hydraulic chambers 9, 9, 9, and 9 and phase-advance hydraulic chambers 10, 10, 10, and 10. In more detail, as clearly shown in FIG. 1, a supply line 44, communicating the discharge port of oil pump 43, is also formed in fluid-line structural block 30 and the engine cylinder head. The downstream end 44*d* of supply line 44 is communicated with a working-fluid chamber 45 defined between the front end face of vane rotor 12 and the inner periphery of each of blades 13. In the shown embodiment, each of at least two blades (13, 13) of the four blades has an inclined oil passage 46 (see FIG. 1, and FIGS. 3–5). As seen from the cross section of FIG. 1, the previously-noted working-fluid chamber 45 is communicated with each of four phase-retard hydraulic chambers 9 and four phase-advance hydraulic chambers 10 through inclined oil passages 46 and 46 and a side clearance space 47. Side clearance space 47 is defined between the rear end face of each blade 13 and the front end face (the left-hand sidewall) of sprocket 1. Side clearance space 47 serves as a fluid-flow constricting orifice (a fixed orifice). The supplementary working-fluid circuit, which is constructed by oil pump 43, supply line 44, working-fluid chamber 45, inclined oil passages 46 and 46, and side clearance space 47, permits part of lubricating oil (working fluid) discharged from oil pump 43 to flow into each of hydraulic chambers 9 and 10 through supply line 44, working-fluid chamber 45, inclined oil passages 46 and 46, and side clearance space 47. This enables air mixed in working fluid in each of hydraulic chambers 9 and 10 to be forcibly exhausted through the porous housing 5 to the exterior space, and also enables compensation for the insufficiency of oil corresponding to the quantity of air exhausted. An oil-purifying filter 48 is also disposed in the upstream portion of supply line 44. Additionally, a one-way check valve 49 is disposed in supply line 44 and located downstream of oil-purifying filter 48 in a manner so as to permit only the working-fluid flow to the downstream direction of supply line 44.

Electronic control unit (ECU) 33 generally comprises a microcomputer. ECU 33 includes an input/output interface (I/O), memories (RAM, ROM), and a microprocessor or a central processing unit (CPU). The input/output interface (I/O) of ECU 33 receives input information from various engine/vehicle switches and sensors, namely a crank angle sensor (or a crankshaft position sensor), a cam angle sensor (or a camshaft position sensor), an airflow meter, an engine temperature sensor (or an engine coolant temperature sensor), a throttle valve opening sensor (or a throttle position sensor), and an ignition switch. The crank angle sensor is provided for detecting revolutions of the engine crankshaft. Assuming that the number of engine cylinders is "n", the crank angle sensor generates a reference pulse signal REF at a predetermined crank angle for every crank angle 720°/n, and simultaneously generates a unit pulse signal (1° or 2°). The processor of ECU 33 arithmetically calculates engine speed Ne based on the period of the reference pulse signal REF from the crank angle sensor. The cam angle sensor generates a cam-angle sensor signal indicative of an angular position $\theta_{CAM}$ of camshaft 2. The airflow meter measures or detects a quantity Qa of fresh air entering the engine cylinders. Engine temperature sensor detects an engine temperature, such as an engine coolant temperature Tw. The throttle valve opening sensor is located near an electronically-controlled throttle to generate a throttle sensor signal indicative of a throttle opening TVO, which is generally defined as a ratio of an actual throttle angle to a throttle angle obtained at wide open throttle. The ignition switch generates an ignition switch signal indicative of whether the ignition switch is turned ON or turned OFF. Within ECU 33, the central processing unit (CPU) allows the access by the I/O interface of input informational data signals from the previously-discussed engine/vehicle switches and sensors. The CPU of ECU 33 is responsible for carrying the valve timing control program (the motor/directional-control-valve control program for valve timing control or phase control based on an engine operating condition containing at least one of engine speed and engine load), the engine-stop-period phase control program (described later in reference to the flow chart shown in FIG. 8), and the fail-safe program (described later in reference to the flow chart shown in FIG. 9) stored in memories and is capable of performing necessary arithmetic and logic operations. Computational results (arithmetic calculation results), that is, calculated output signals are relayed through the output interface circuitry of ECU 33 to output stages, namely non-reversible electric motor 31, and an electromagnetic solenoid (described later) of electromagnetic directional control valve 22. The output interface circuitry of ECU 33 is also connected to a warning system having a warning buzzer and/or an instrument-cluster warning lamp 33WL (described later), which comes on in response to an alarm signal from ECU 33. Basically, the processor of ECU 33 estimates or determines the current engine operating condition based on the latest up-to-date information from the engine/vehicle switches and sensors. Thereafter, the processor of ECU 33 executes motor current control for motor 31 of motor-driven oil pump 18 and simultaneously executes pulse signal control (PWM control) for electric current applied to coil 38*b* of electromagnetic directional control valve 22. More concretely, the variable valve timing control system of the embodiment of FIGS. 1–2 operates as follows.

Figure 3:
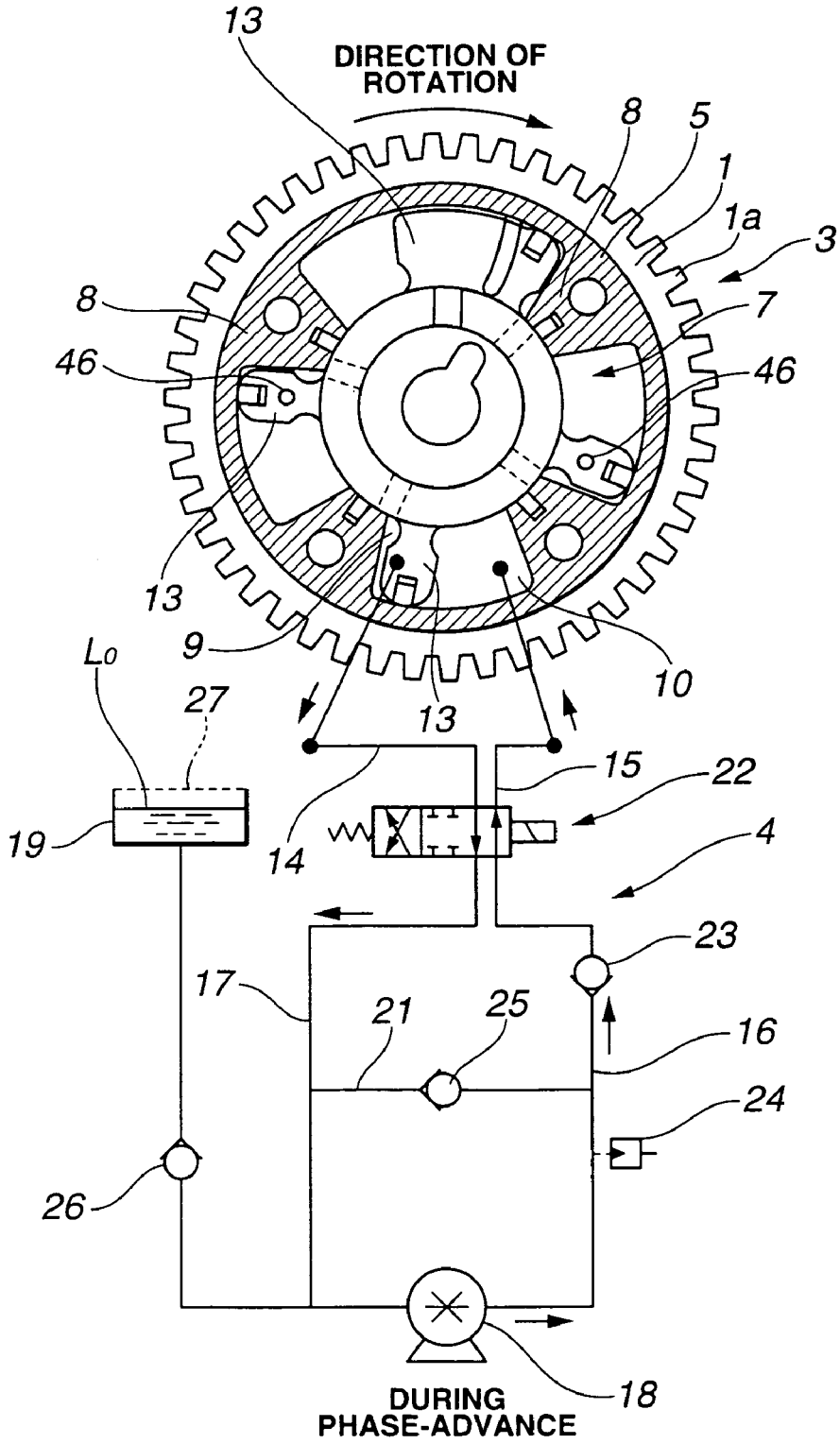
FIG. 3 is an explanatory view showing the variable valve timing control system controlled to a phase-advance position.

In a low engine speed and low engine load range (or with the engine at an idle rpm) just after the engine has been started, a control current is applied to motor 31 so as to rotate motor 31 in such a manner as to achieve an engine valve timing suitable to low engine speed and low engine load operation, while coil 38*b* of directional control valve 22 is de-energized with the duty ratio of the PWM signal switched to "0%". Under such a low speed and low load condition, as shown in FIGS. 6A and 3, spool 36 axially slides toward the leftmost spool position (the spring-offset position) by the spring force of valve spring 37, and is held at the spring-offset position. Owing to the axial positions of lands 36*a*–36*c* with spool 36 held at the spring-offset position, fluid communication between discharge line 16 and phase-advance hydraulic line 15 is established, fluid communication between discharge line 16 and phase-retard hydraulic line 14 is blocked, and at the same time fluid communication between phase-retard hydraulic line 14 and induction line 17 (or drain line 39) is established. Thus, as appreciated from the arrow indicating the fluid-flow direction in FIG. 3, working fluid discharged from trochoid pump 32 flows into each of phase-advance hydraulic chambers 10 through discharge line 16, check valve 23, and phase-advance hydraulic line 15, whereas working fluid in each of phase-retard hydraulic chambers 9 flows into induction line 17 through phase-retard hydraulic line 14 and then returns to the inlet port 32*f* (see FIG. 2) of trochoid pump 32 (motor-driven oil pump 18). As a result of this, the hydraulic pressure in each of phase-retard hydraulic chambers 9 becomes relatively low, whereas the hydraulic pressure in each of phase-advance hydraulic chambers 10 becomes relatively high. As shown in FIG. 3, each of blades 13 of the hydraulically-operated vane-type phase converter 3 rotates in the same rotational direction (in the clockwise direction) as the valve operating mechanism including sprocket 1 and camshaft 2, and therefore the angular phase of camshaft 2 relative to sprocket 1 can be converted and phase-advanced. Thus, an open-and-closure timing of the engine valve, for example, an intake valve open timing IVO and an intake valve closure timing IVC, can be phase-advanced. By virtue of the phase-advanced IVO and IVC suitable to the low speed and low load operation, it is possible to remarkably enhance the combustion efficiency, utilizing inertial intake-air mass, thereby enhancing the combustion stability and reducing the fuel consumption rate during the low speed and low load condition. Thereafter, when the maximum phase-advanced position of camshaft 2 has been reached by way of the previously-discussed phase-advance action, the cam angle sensor generates a cam-angle sensor signal indicative of the maximum phase-advanced position of camshaft 2 relative to sprocket 1. Responsively to the cam-angle sensor signal indicative of the maximum phase-advanced position of camshaft 2, ECU 33 operates to reduce the applied motor current value to "0" so as to stop non-reversible electric motor 31. At the same time, ECU 33 controls the duty ratio of the PWM signal applied to coil 38*b* of electromagnetic directional control valve 22 to the previously-noted predetermined middle duty ratio, such that the spring force of valve spring 37 and the repulsion force created by coil 38*b* of the solenoid-actuated directional control valve are suitably balanced to each other and thus spool 36 is held at the intermediate axial position shown in FIG. 6B. Holding spool 36 at the intermediate axial position of FIG. 6B by way of the PWM control for electric current applied to coil 38*b*, means that the first port 35*a* is closed by the first land 36*a*, and simultaneously the second port 35*b* is closed by the second land 36*b*. As a result, vane member 7 can be maintained at its maximum phase-advanced angular position (see FIG. 3).

Figure 4:
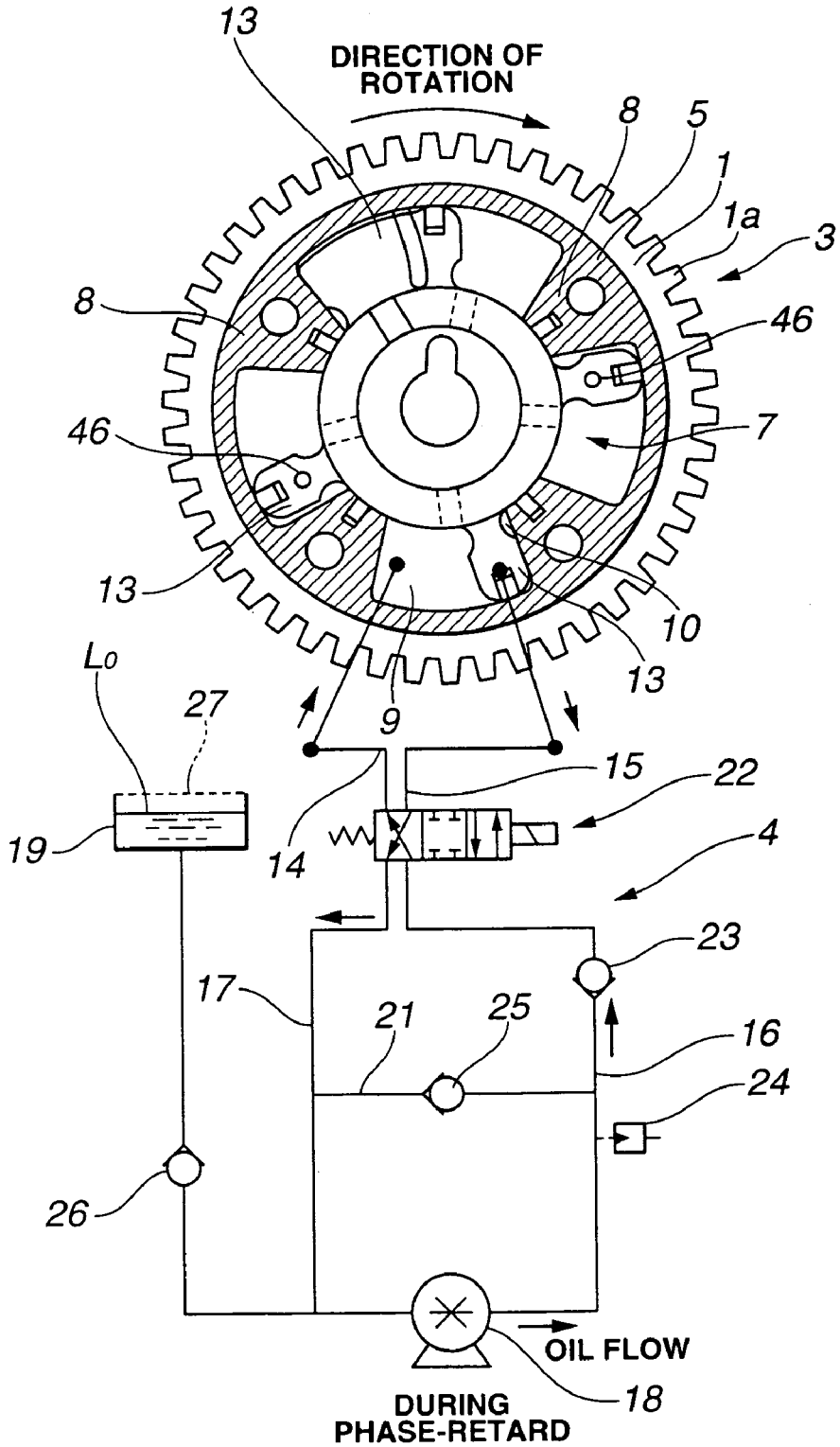
FIG. 4 is an explanatory view showing the variable valve timing control system controlled to a phase-retard position.

Thereafter, assuming that the engine operating condition has been changed from low speed and low load operation to high speed and high load operation, a control current is applied to motor 31 so as to change from the valve timing (IVO, IVC) suitable to low speed and low load operation to the valve timing (IVO, IVC) suitable to high speed and high load operation, while the PWM signal of a high duty ratio suitable to the high speed and high load operation is applied to coil 38*b* of directional control valve 22. Under such a high speed and high load condition, as shown in FIGS. 6C and 4, spool 36 axially slides toward the rightmost spool position (the maximum actuated position) against the spring force of valve spring 37, and is held at the maximum actuated position. Owing to the axial positions of lands 36*a*–36*c* with spool 36 held at the maximum actuated position, fluid communication between discharge line 16 and phase-retard hydraulic line 14 is established, fluid communication between discharge line 16 and phase-advance hydraulic line 15 is blocked, and at the same time fluid communication between phase-advance hydraulic line 15 and induction line 17 is established. Thus, as appreciated from the arrow indicating the fluid-flow direction in FIG. 4, working fluid in each of phase-advance hydraulic chambers 10 flows through phase-advance hydraulic line 15 and directly returns to induction line 17, whereas working fluid discharged from trochoid pump 32 (motor-driven oil pump 18) flows into each of phase-retard hydraulic chambers 9 through discharge line 16, check valve 23, and phase-retard hydraulic line 14. As a result of this, the hydraulic pressure in each of phase-retard hydraulic chambers 9 becomes relatively high, whereas the hydraulic pressure in each of phase-advance hydraulic chambers 10 becomes relatively low. As shown in FIG. 4, each of blades 13 of the hydraulically-operated vane-type phase converter 3 rotates in the opposite direction (in the anticlockwise direction) opposing to the rotational direction of the valve operating mechanism including sprocket 1 and camshaft 2, and therefore the angular phase of camshaft 2 relative to sprocket 1 can be converted and phase-retarded. Thus, the IVO and IVC are phase-retarded. By virtue of the phase-retarded IVO and IVC suitable to the high speed and high load operation, it is possible to remarkably enhance the engine power output during the high speed and high load condition. Thereafter, when the maximum phase-retarded position of camshaft 2 has been reached by way of the previously-discussed phase-retard action, the cam angle sensor generates a cam-angle sensor signal indicative of the maximum phase-retarded position of camshaft 2 relative to sprocket 1. Responsively to the cam-angle sensor signal indicative of the maximum phase-retarded position of camshaft 2, ECU 33 operates to reduce the applied motor current value to "0" so as to stop the motor. At the same time, ECU 33 controls the duty ratio of the PWM signal applied to coil 38*b* of electromagnetic directional control valve 22 to the previously-noted predetermined middle duty ratio, such that the spring force of valve spring 37 and the repulsion force created by coil 38*b* of the solenoid-actuated directional control valve are suitably balanced to each other and thus spool 36 is held at the intermediate axial position shown in FIG. 6B. Holding spool 36 at the intermediate axial position of FIG. 6B by way of the PWM control for electric current applied to coil 38*b*, means that the first port 35*a* is closed by the first land 36*a*, and simultaneously the second port 35*b* is closed by the second land 36*b*. As a result, vane member 7 can be maintained at its maximum phase-retarded angular position (see FIG. 4).

Figure 5:
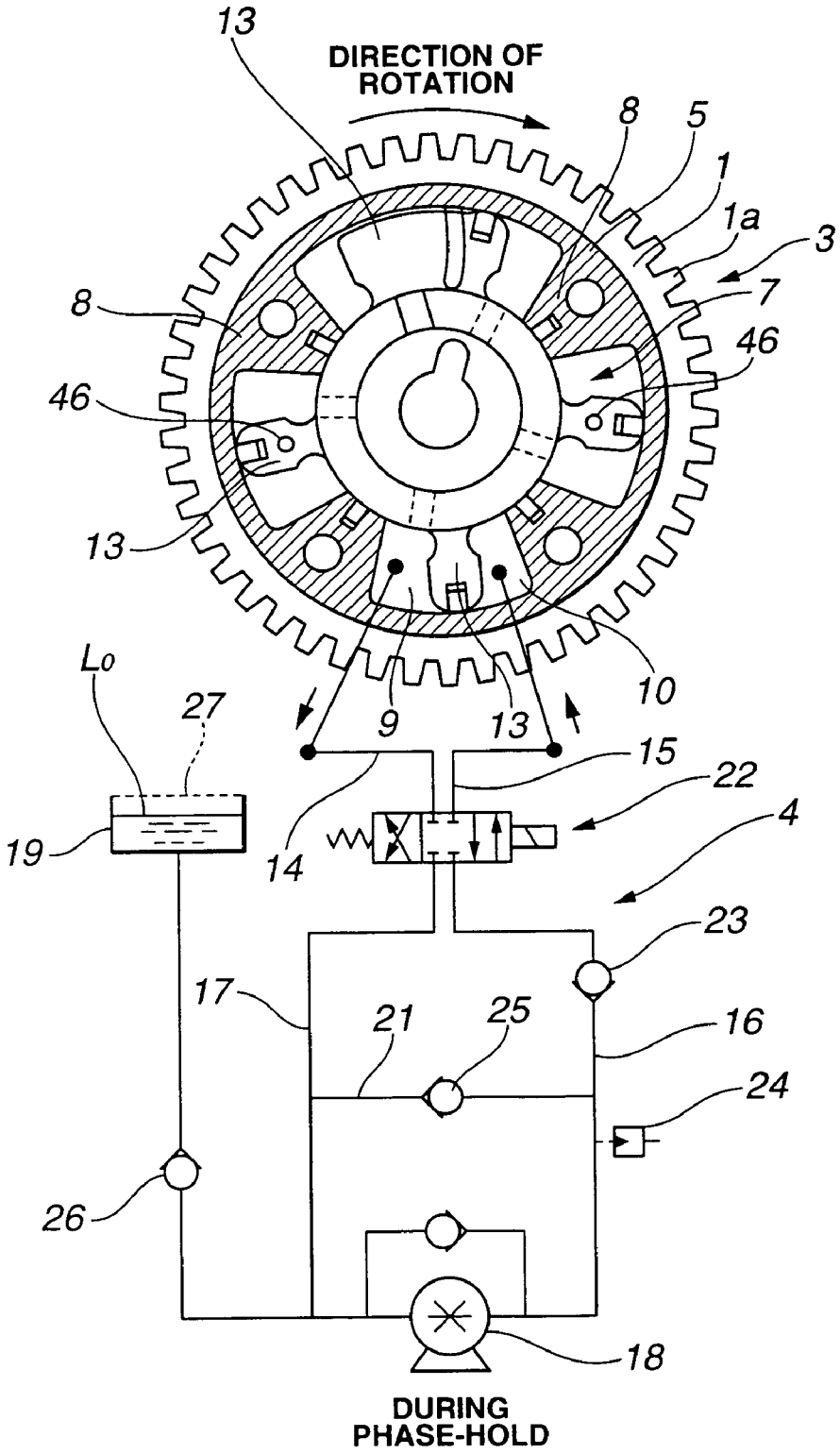
FIG. 5 is an explanatory view showing the variable valve timing control system held in an intermediate position during a phase-hold operating mode.

Thereafter, assuming that the engine operating condition has been changed from the high speed and high load operation to middle speed and middle load operation, by way of both of motor current control for electric motor 31 and PWM control for electric current applied to coil 38*b* of the solenoid-actuated directional control valve 22, vane member 7 rotates clockwise from its maximum phase-retarded angular position toward its intermediate angular position shown in FIG. 5. Immediately when the intermediate angular position of vane member 7 has been reached (see FIG. 5), ECU 33 controls the duty ratio of the PWM signal applied to coil 38*b* of directional control valve 22 to the previously-noted predetermined middle duty ratio, so that spool 36 is held at the intermediate axial position shown in FIG. 6B. By holding spool 36 at the intermediate axial position of FIG. 6B by way of the PWM control for electric current applied to coil 38*b*, vane member 7 can be maintained at the intermediate angular position (see FIG. 5) located midway between the maximum phase-advanced angular position and the maximum phase-retarded angular position. As a result of this, it is possible to realize the optimal valve timing control suitable to the middle engine speed and middle engine load, thus balancing two contradictory requirements, namely reduced fuel consumption rate and enhanced engine power output during the middle speed and middle load condition.

Thereafter, suppose that the engine operating condition shifts from the middle speed and middle load operation (or the low speed and low load operation) to engine stop operation. During a time period of engine idling that the engine is shifting to the stopped state, as described later in reference to the flow chart of FIG. 8, ECU 33 executes the engine-stop-period phase control routine. Briefly speaking, during the time period of engine idling that the engine is shifting to the stopped state, the engine valve timing (IVO, IVC) is temporarily controlled to the phase-retard direction, that is, vane member 7 is temporarily controlled to its maximum phase-retarded angular position by way of both of motor current control for electric motor 31 and PWM control for electric current applied to coil 38*b* of the solenoid-actuated directional control valve. Exactly speaking, during a time period from a point of time when the ignition switch becomes turned OFF to a point of time when the engine stopped state has been completed, in other words, during the engine-stop-period phase control, electric motor-driven pump 18, which is in operative (ON) during phase change, is further driven continuously for a brief moment, even after the ignition switch has been turned OFF, or electric motor-driven pump 18, which is in inoperative (OFF) after completion of phase change, is driven momentarily for a brief moment, even after the ignition switch has been turned OFF. By momentarily driving electric motor-driven pump 18 for a brief moment after the turning-OFF action of the ignition switch, vane member 7 can be shifted or preset to such an engine-restart standby position (such an engine-restartable valve-timing position) as to be properly phase-advanced from the maximum phase-retarded angular position (the initial position or the reference phase-angle position) shown in FIG. 4 to the intermediate angular position shown in FIG. 5. The engine-restart standby position substantially corresponds to a valve timing (a relative angular position of camshaft 2 to sprocket 1), which is preprogrammed to be suitable for an engine restarting period. Presetting vane member 7 to the engine-restart standby position enhances or improves the engine restartability.

As can be appreciated from the above, the hydraulically-operated phase converter equipped variable valve timing control system of the embodiment can provide the following operation and effects (1)–(12).

Figure 7:
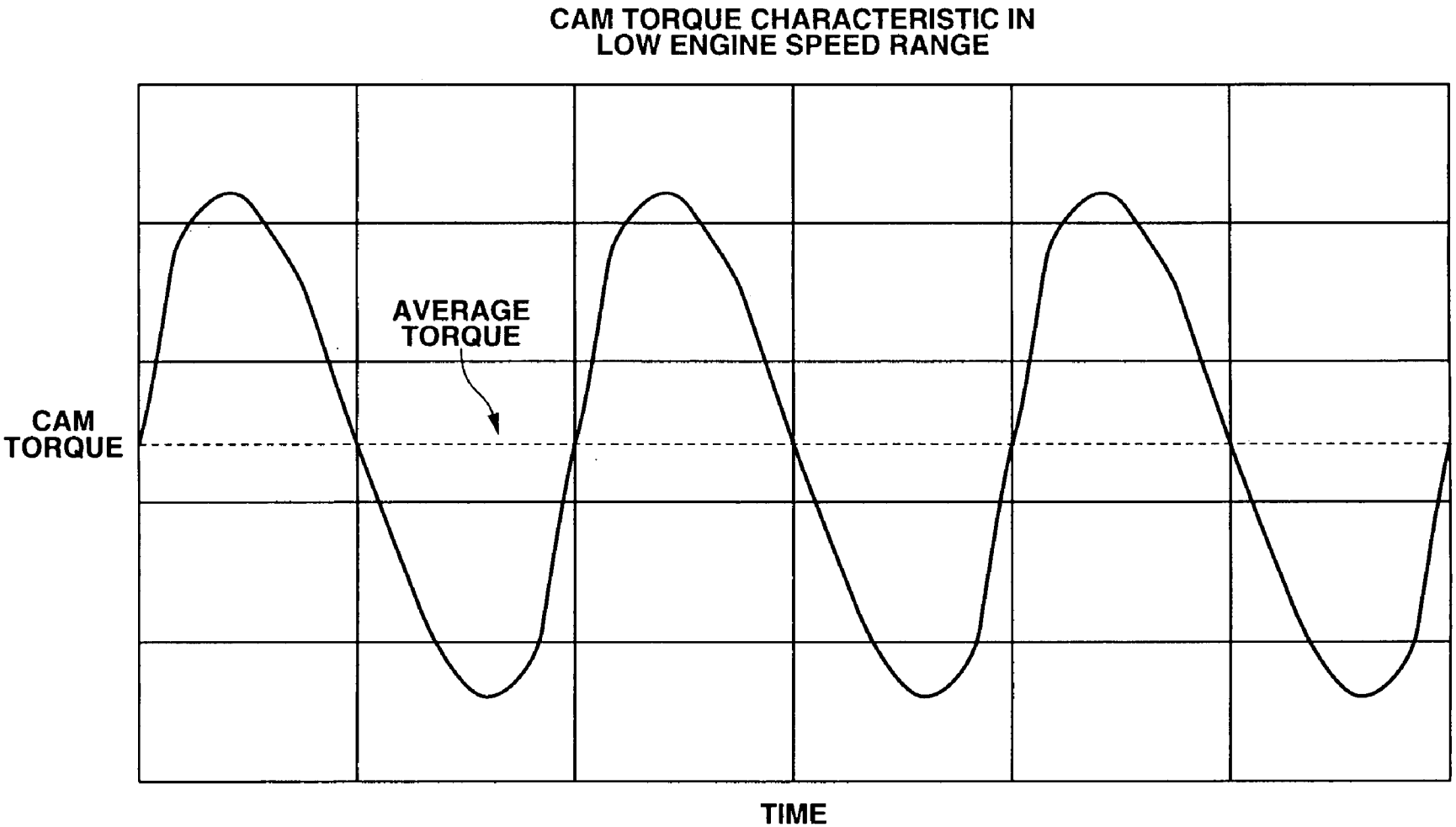
FIG. 7 is a graph showing a waveform characteristic of alternating torque exerted on a camshaft of an internal combustion engine.

(1) As is generally known, for instance, in the low engine speed range, a comparatively large magnitude of alternating torque (see FIG. 7) whose oscillation frequency is large, may be exerted on the camshaft owing to the spring force of the engine valve spring for each engine valve and the reaction force resulting from each engine valve opening and closing during operation of the engine. Owing to the alternating torque transmitted from camshaft 2 to vane member 7, a pulse pressure is applied to the working fluid in each of phase-retard hydraulic chambers 9, 9, 9, and 9, and phase-advance hydraulic chambers 10, 10, 10, and 10. For the reasons discussed above, during the phase-retard operating mode, usually, there is an increased tendency for the pulse pressure to be transmitted from phase-retard hydraulic line 14 to discharge line 16. In the system of the embodiment, on the one hand, check valve 23 is disposed in discharge line 16. Thus, it is possible to effectively block or shut off the undesirable transmission of pulse pressure from phase-retard hydraulic line 14 to discharge line 16, thereby effectively suppressing or preventing the load (i.e., undesirable energy loss) carried on the motor shaft of non-reversible electric motor 31 of pump 18 from undesirably increasing. In the system of the embodiment, on the other hand, there is no check valve disposed in induction line 17. Thus, the pulse pressure can be permitted to be transmitted from phase-advance hydraulic chamber 10 through phase-advance hydraulic line 15 to induction line 17 during the phase-retard operating mode. The pulse pressure promotes the outflow of working fluid from phase-advance hydraulic chamber 10 through phase-advance hydraulic line 15 and induction line 17 to inlet port 32*f*. The promoted outflow serves as an assistance force (an assistive drive source for electric motor-driven pump 18), thus effectively reducing electric load needed to drive the motor shaft of non-reversible electric motor 31 of pump 18. In other words, during operation of the system of the embodiment, the system permits the pulse pressure to be transmitted from induction line 17 through inlet and outlet ports 32*f* and 32*e* of pump 18 to discharge line 16, and whereby the pulse pressure acts as an assistance force (an assistive drive source for electric motor-driven pump 18). As a result, the system of the embodiment realizes small-sizing of electric motor-driven pump 18 and reduced manufacturing costs.

(2) When pump 18 is in inoperative during the phase-hold operating mode, each of the first and second ports 35*a* and 35*b* of directional control valve 22 are closed and thus there is no fluid flow through directional control valve 22 kept at the shut-off position. During the phase-hold operating mode, it is possible to certainly prevent the pulse pressure arising from the alternating torque from being transmitted from either one of phase-retard hydraulic line 14 and phase-advance hydraulic line 15 via directional control valve 22 to either one of discharge line 16 and induction line 17. Thus, it is possible to avoid the electric load needed to drive the motor shaft of non-reversible electric motor 31 of pump 18 from being affected by the pulse pressure during the phase-hold operating mode. Thus, it is possible to reduce the amount of electric current supplied to motor 31 when re-driving the motor shaft of motor 31.

(3) When the motor shaft of motor 31 of electric motor-driven pump 18 begins to rotate and thus the pumping action is insufficient or when pump 18 cannot be satisfactorily rotated owing to a pump failure (or a motor failure), bypass check valve 25 can be opened with the aid of the pulse pressure arising from the alternating torque and transmitted to induction line 17. With bypass check valve 25 opened with the aid of the pulse pressure, the working-fluid flow from induction line 17 via bypass line 21 to discharge line 16 is permitted, thus enabling working-fluid supply from one of phase-retard hydraulic chamber 9 and phase-advance hydraulic chamber 10 via bypass line 21 to the other during low pump speed operation of pump 18 or in presence of a failure in pump 18. Thus, it is possible to operate the hydraulically-operated phase converter 3 by suitably controlling electromagnetic directional control valve 22 depending on an engine operating condition, even during low pump speed operation of pump 18 or in presence of a failure in pump 18.

(4) Furthermore, phase-converter housing 5 is comprised of a porous housing, which is made of a porous sintered metal member such as sintered alloy materials. Even when air has been mixed in working fluid in each of phase-retard hydraulic chamber 9 and phase-advance hydraulic chamber 10 owing to oil leakage from the interior of phase converter 3 or oil leakage from each of phase-retard hydraulic line 14 and phase-advance hydraulic line 15, and discharge line 16 and induction line 17, arranged between pump 18 and phase converter 3 in the engine stopped state, it is possible to exhaust the air through the porous housing 5 to the exterior space by operating pump 18 and by rising the hydraulic pressure in each of hydraulic chambers 9 and 10. As a result, it is possible to prevent the control accuracy of variable valve timing control accomplished by means of phase converter 3 from being deteriorated owing to the air mixed in working fluid in each of hydraulic chambers 9 and 10. From the property of the porous housing 5, made of a porous sintered metal material, housing 5 permits only the air mixed in working fluid in each of hydraulic chambers 9 and 10 to be exhausted to the exterior space, but prevents undesirable leakage of working fluid having a comparatively high viscosity, thus avoiding a pressure drop in working fluid delivered from discharge line 16 to either one of hydraulic chambers 9 and 10.

(5) Moreover, reservoir check valve 26 is disposed in supply line 20 (see FIGS. 1–2) arranged between induction line 17 and reservoir 19, to permit only the working-fluid flow from reservoir 19 via reservoir check valve 26 to induction line 17, and to prevent any flow in the opposite direction. In the engine stopped state, it is possible to effectively charge and store or hold working fluid in induction line 17, thus preventing air from being mixed in working fluid in induction line 17.

(6) As can be seen from the system block diagram of FIG. 1 and the hydraulic circuit of FIG. 2, the level of installation of reservoir 19 is set to be higher than the level of installation of the hydraulically-operated phase converter 3 in a direction of acceleration of gravity. By way of the setting of installation of reservoir 19 higher than the level of installation of the hydraulically-operated phase converter 3, the working fluid in reservoir 19 can be sufficiently charged and stored in the fluid lines arranged between phase converter 3 and pump 18, even in the engine stopped state. Thus, it is possible to prevent a vacuum from being created in the hydraulic pressure system laid out between phase converter 3 and pump 18, thus preventing air from being undesirably mixed in working fluid in each of the hydraulic lines arranged between phase converter 3 and pump 18.

(7) Additionally, oil-purifying filter 27 of reservoir 19 is installed at a higher level than the oil level Lo of working fluid stored in reservoir 19 in a direction of acceleration of gravity. The working fluid splashed during operation of the valve operating mechanism tends to be dripped onto the upper face of oil-purifying filter 27. Thus, it is possible to effectively filter out or remove dust, dirt, or other contaminants mixed in the working fluid through oil-purifying filter 27. The upper oil-purifying filter 27, which is laid out at a higher level than the oil level Lo of reservoir 19, never serves as a fluid-flow resistance, in other words, an undesirable load carried on the motor shaft of electric motor-driven pump 18 during working-fluid supply from reservoir 19 to pump 18. This prevents or avoids the responsiveness of operation of electric motor-driven pump 18 from being deteriorated.

(8) To provide the fluid-tight sealing action for each of phase-retard hydraulic chambers 9, 9, 9, and 9 and phase-advance hydraulic chambers 10, 10, 10, and 10 of phase converter 3 and to prevent leakage of working fluid from at least hydraulic chambers 9 and 10, oil seals 41*a*, 41*b*, 41*b*, and 41*b* are placed at the fitting portion between front cover 11 and fluid-line structural block 30 formed with phase-retard hydraulic line 14, phase-advance hydraulic line 15 and supply line 44. Oil seals 42*a* and 42*a* are placed at the fitting portions between phase-converter housing 5 and front cover 11 and between phase-converter housing 5 and sprocket 1. An oil seal 42*b* is also placed at the fitting portion between vane rotor 12 and sprocket 1. Thus, it is possible to effectively prevent leakage of oil from at least phase-retard hydraulic chambers 9, 9, 9, and 9 and phase-advance hydraulic chambers 10, 10, 10, and 10, in the engine stopped state, thereby preventing air from being mixed in working fluid in each of hydraulic chambers 9 and 10.

(9) For the purpose of working fluid supply (or hydraulic pressure supply), electric motor-driven oil pump 18 is provided as a main working fluid source (or a main hydraulic pressure source). Also provided is oil pump 43 that supplies moving engine parts with lubricating oil and serves as a supplementary working-fluid source (or a supplementary pump operable independently of electric motor-driven pump 18) for the hydraulically-operated phase converter 3. Phase converter 3 is formed with an air bleeder (air bleeding means) that acts to exhaust air undesirably mixed in working fluid in each of hydraulic chambers 9 and 10 to the exterior space. As discussed above, the porous phase-converter housing 5, which is made of a porous sintered metal material, serves as the air bleeder. By the aid of the working fluid pressurized by and oil pump 43 and discharged and routed from oil pump 43 (the supplementary working-fluid source) through supply line 44, working-fluid chamber 45, inclined oil passages 46 and 46 and side clearance space 47 into each of phase-retard hydraulic chamber 9 and phase-advance hydraulic chamber 10, it is possible to effectively forcibly exhaust the air mixed in working fluid in each of hydraulic chambers 9 and 10 through the porous housing 5 (serving as the air bleeder) to the exterior space. At the same time, by the aid of the pressurized working fluid discharged from oil pump 43 (the supplementary working-fluid source) to each of hydraulic chambers 9 and 10, it is possible to suitably compensate for the insufficiency of oil (working fluid) corresponding to the quantity of air exhausted. As a result, it is possible to prevent the control accuracy of variable valve timing control (phase control) of phase converter 3 from being deteriorated owing to the air mixed in working fluid in each of hydraulic chambers 9 and 10. Additionally, even when electric motor-driven pump 18 of two pumps 18 and 43 has been failed, it is possible to charge or feed working fluid from oil pump 43 to each of hydraulic chambers 9 and 10 of phase converter 3.

(10) As previously described (see the effect (3)), with bypass check valve 25 opened due to the pulse pressure, the working-fluid flow from induction line 17 through bypass line 21 to discharge line 16 is permitted, thus enabling working-fluid supply from one of hydraulic chambers 9 and 10 via bypass line 21 to the other during low pump speed operation of pump 18 or in presence of a failure of pump 18. Moreover, in the system of the embodiment, even during low pump speed operation of pump 18 or in presence of a failure in pump 18, it is possible to deliver or feed working fluid from oil pump 43 (the supplementary working-fluid source) through supply line 44, working-fluid chamber 45, inclined oil passages 46 and 46 and side clearance space 47 into each of hydraulic chambers 9 and 10. Thus, it is possible to more certainly keep a sufficient working-fluid charged state wherein working fluid is satisfactorily charged and stored in each of hydraulic chambers 9 and 10, even during low pump speed operation of pump 18 or in presence of a failure in pump 18.

(11) Furthermore, the working fluid, discharged from oil pump 43 (the supplementary working-fluid source), and then routed through the working-fluid passage 44–46 into each of hydraulic chambers 9 and 10 can be greatly restricted or constricted by means of a fluid-flow constricting orifice (side clearance space 47) located downstream of the working-fluid passage 44–46 and intercommunicating both of phase-retard hydraulic chamber 9 and phase-advance hydraulic chamber 10. By the provision of the fluid-flow constricting orifice (side clearance space 47), it is possible to prevent a pressure differential between phase-retard hydraulic chamber 9 and phase-advance hydraulic chamber 10 from being created during operation of oil pump 43. That is to say, the fluid-flow constricting orifice (side clearance space 47) acts to avoid or prevent the hydraulically-operated phase converter 3 from being undesirably operated owing to the working-fluid supply from oil pump 43 to each of hydraulic chambers 9 and 10 of phase converter 3. Additionally, the fluid-flow constricting orifice is comprised of side clearance space 47, which is defined between the inner peripheral surface of phase-converter housing 5 and the end face of vane member 7 in sliding-contact with the inner peripheral surface of housing 5. More concretely, the fluid-flow constricting orifice is comprised of side clearance space 47, which is defined between the rear end face of each blade 13 of vane member 7 and the front end face (the left-hand sidewall) of sprocket 1. In this manner, the fluid-flow constricting orifice (side clearance space 47) is simply formed or defined between the existing phase-converter housing 5 and vane member 7. Thus, there is no necessity of an additional orifice. Side clearance space 47, easily simply defined between vane member 7 and sprocket 1, contributes to the simplified hydraulic circuit (or the simplified hydraulic system) for the hydraulically-operated phase converter 3.

(12) Also provided is oil-purifying filter 48 disposed in the upstream portion of supply line 44 of oil pump 43 (the supplementary working-fluid source). By the provision of oil-purifying filter 48 disposed in supply line 44, it is possible to effectively filter out or remove dust, dirt, or other contaminants contained in working fluid discharged from oil pump 43 through oil-purifying filter 48. Oil-purifying filter 48 disposed in supply line 44 serves as a fluid-flow resistance, thus producing a slight energy loss (i.e., a slight pressure drop). However, there is no problem, since oil pump 43 itself functions as the supplementary working-fluid source that supplies a slight amount of working fluid to the hydraulically-operated phase converter 3, if needed.

Figure 8:
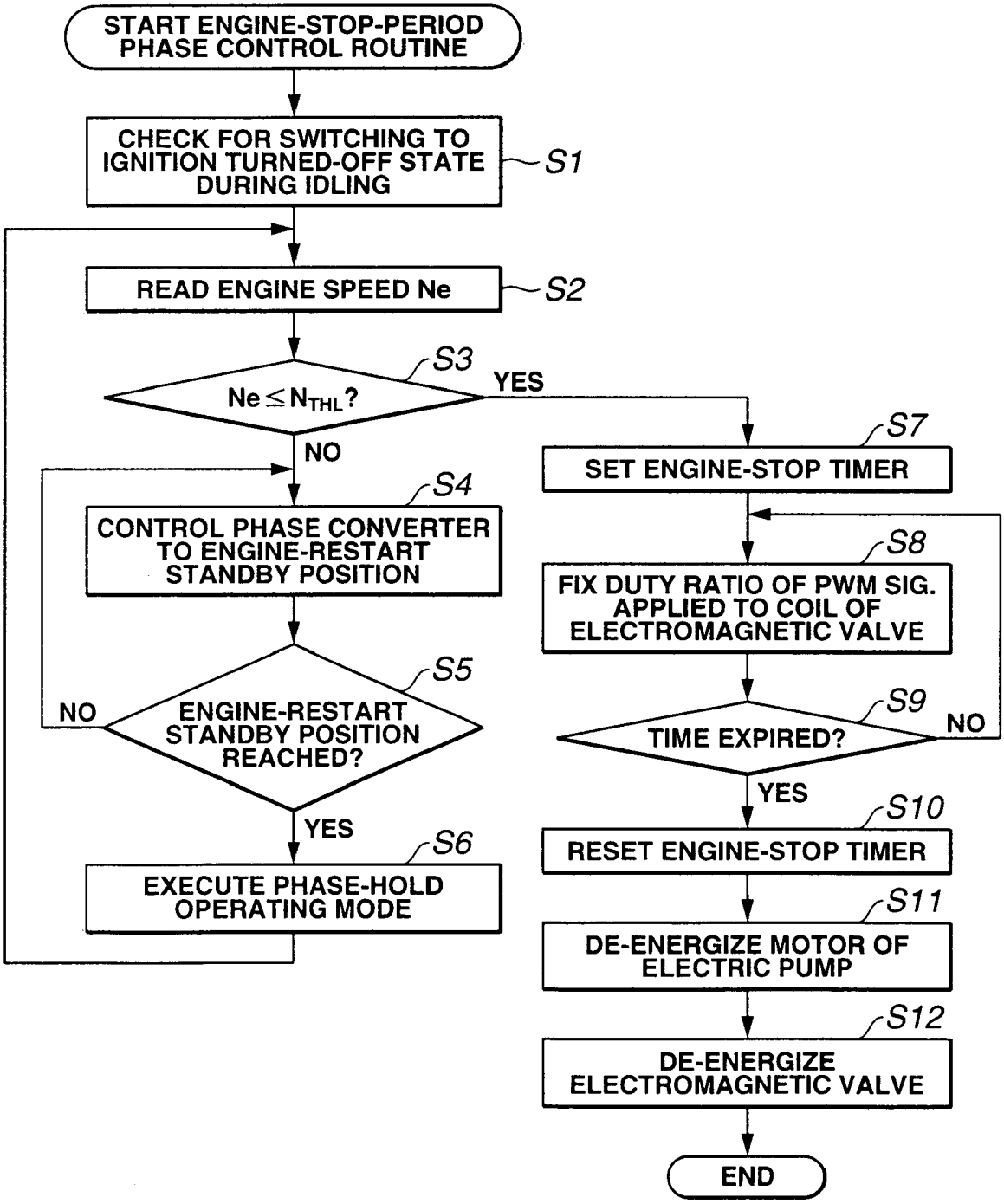
FIG. 8 is a flow chart showing an engine-stop-period phase control routine executed within a controller incorporated in the variable valve timing control system of the embodiment.

Referring now to FIG. 8, there is shown the engine-stop-period phase control routine executed within the processor of ECU 33 incorporated in the variable valve timing control system of the embodiment. The engine-stop-period phase control routine shown in FIG. 8 is executed as time-triggered interrupt routines to be triggered every predetermined time intervals such as 10 milliseconds.

At step S1, a check is made to determine whether switching from the turned-ON state of the ignition switch to the turned-OFF state occurs during idling of the engine. When the answer to step S1 is in the affirmative (YES), that is, when the ignition switch becomes turned OFF, the routine proceeds from step S1 to step S2. When the answer to step S1 is in the negative (NO), that is, when the ignition switch remains turned ON, the routine returns to the main program to execute the usual variable valve timing control based on the current engine operating condition.

At step S2, the latest up-to-date information concerning engine speed Ne, determined based on the sensor signal from the crank angle sensor, is read.

At step S3, a check is made to determine whether the current engine speed Ne is less than or equal to a predetermined engine-speed lower limit $N_{THL}$, such as 50 rpm. When the answer to step S3 is negative (NO), that is, in case of $Ne>N_{THL}$, the routine proceeds from step S3 to step S4.

At step S4, under the condition defined by the inequality of $Ne>N_{THL}$, the hydraulically-operated vane-type phase converter 3 (exactly, each of blades 13 of vane member 7 of phase converter 3) is controlled from the initial position (or the reference phase-angle position) obtained at the beginning of the engine starting period to the previously-discussed engine-restart standby position, properly phase-advanced from the maximum phase-retarded angular position shown in FIG. 4 to the intermediate angular position shown in FIG. 5. The initial position of phase converter 3 corresponds to the maximum phase-retard position of camshaft 2

(in other words, the maximum phase-retarded angular position of vane member 7), since vane member 7 tends to rotate toward the maximum phase-retarded angular position due to its inertia at the beginning of the engine starting period. After step S4, step S5 occurs.

At step S5, a check is made to determine, based on the latest up-to-date information concerning cam angle $\theta_{CAM}$ determined based on the cam angle sensor signal, whether the engine-restart standby position of phase converter 3 (i.e., the intermediate angular position of vane member 7 shown in FIG. 5) has been reached. When the answer to step S5 is negative (NO), that is, when the engine-restart standby position of phase converter 3 has not yet been reached, the routine returns from step S5 again to step S4, so as to succeedingly control the hydraulically-operated phase converter 3 to the phase-advance side (exactly, the engine-restart standby position). Conversely when the answer to step S5 is affirmative (YES), that is, when the engine-restart standby position of phase converter 3 has been reached, the routine proceeds from step S5 to step S6.

At step S6, in order to achieve the phase-hold operating mode and to retain the engine-restart standby position of phase converter 3 unchanged, electromagnetic directional control valve 22 is controlled to its shut-off position (i.e., the intermediate axial position of spool 36 shown in FIG. 6B) by way of the PWM control. After step S6, the routine flows from step S6 to step S2 to repeatedly execute the engine-stop-period phase control routine.

Returning to step S3, conversely when the answer to step S3 is affirmative (YES), that is, in case of $Ne \leqq N_{THL}$, the routine proceeds from step S3 to step S7.

At step S7, an engine-stop timer is set to a predetermined delay period during which the shut-off position of electromagnetic directional control valve 22 is retained unchanged, for measuring an elapsed time from the point of time when switching to the ignition-switch turned-OFF state has occurred.

At step S8, the duty ratio of the PWM signal applied to coil 38*b* of electromagnetic directional control valve 22 is fixed to the predetermined middle duty ratio so as to hold electromagnetic directional control valve 22 at the shut-off position.

At step S9, a check is made to determine whether the predetermined delay period of the engine-stop timer initialized at step S7 has expired. When the answer to step S9 is negative (NO), that is, when the predetermined delay period of the engine-stop timer has not yet expired, the routine returns from step S9 to step S8 in order to succeedingly hold electromagnetic directional control valve 22 at the shut-off position. Conversely when the answer to step S9 is affirmative (YES), that is, when the delay period of the engine-stop timer has expired, the routine advances from step S9 to step S10.

At step S10, the engine-stop timer is reset. After step S10, steps S11 and S12 occur.

At step S11, the electric current applied to non-reversible electric motor 31 of motor-driven oil pump 18 is controlled to "0" to stop electric motor 31 of pump 18.

At step S12, the duty ratio of the PWM signal applied to coil 38*b* of electromagnetic directional control valve 22 is controlled to the predetermined low duty ratio such as "0%", so as to de-energize electromagnetic directional control valve 22.

As set out above, in accordance with the engine-stop-period phase control shown in FIG. 8, the angular phase of camshaft 2 relative to sprocket 1 can be properly converted and phase-controlled to a predetermined phase-advanced position corresponding to the previously-noted engine-restart standby position (see FIG. 5) of vane member 7, properly phase-advanced from the maximum phase-retarded angular position (see FIG. 4). Presetting vane member 7 to the engine-restart standby position enhances or improves the engine restartability. Therefore, the engine-restart standby position of vane member 7 means a better restartability angular-phase position.

Figure 9:
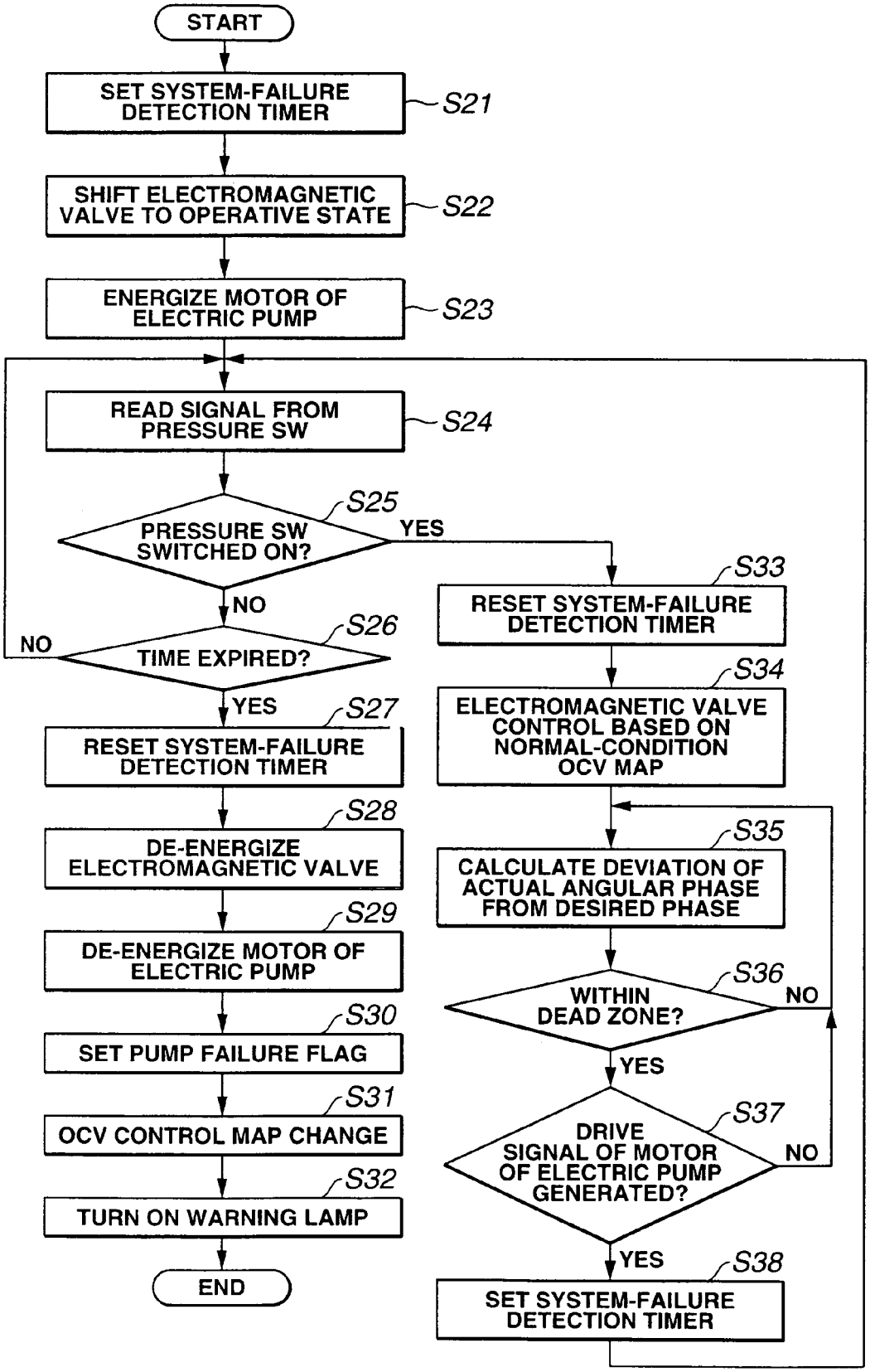
FIG. 9 is a flow chart showing a fail-safe routine executed within the controller in presence of a motor failure.

Referring now to FIG. 9, there is shown the fail-safe routine executed within the processor of ECU 33 in presence of a failure in non-reversible electric motor 31 or a failure in electric motor-driven pump 18. The fail-safe routine shown in FIG. 9 is also executed as time-triggered interrupt routines to be triggered every predetermined time intervals such as 10 milliseconds.

At step S21, just after switching to the ignition-switch turned-ON state, a system-failure detection timer is set to a predetermined delay period representing the time allowed for pressure switch 24 to be switched ON if there is no system failure, more concretely, if electric motor-driven pump 18 and/or non-reversible electric motor 31 is unfailed and operating normally.

At step S22, the solenoid-actuated directional control valve 22 is shifted to its operative state. Actually, coil 38*b* of directional control valve 22 is energized and de-energized by a duty cycle pulsewidth modulated (PWM) signal at a controlled duty ratio, so that the axial position of spool 36 of the solenoid-actuated directional control valve 22 is controlled and axially slid for a phase change (a phase advance or a phase retard), which is determined based on the current engine operating condition. For instance, when the phase advance is required, the duty ratio of the PWM signal applied to coil 38*b* is set to the predetermined low duty ratio such as "0%", such that spool 36 is controlled to the spring-offset position in which fluid communication between discharge line 16 and phase-advance hydraulic line 15 is established and simultaneously fluid communication between induction line 17 (or drain line 39) and phase-retard hydraulic line 14 is established, in order to attain the phase-advance operating mode. Conversely when the phase retard is required, the duty ratio is set to the predetermined high duty ratio such as "100%", such that spool 36 is controlled to the maximum actuated position in which fluid communication between discharge line 16 and phase-retard hydraulic line 14 is established and simultaneously fluid communication between induction line 17 and phase-advance hydraulic line 15 is established, in order to attain the phase-retard operating mode.

At step S23, electric motor 31 is energized.

At step S24, a switch signal from pressure switch 24 is read.

At step S25, a check is made to determine whether the switch signal from pressure switch 24 is high, in other words, pressure switch 24 is switched ON. When the answer to step S25 is negative (NO), that is, when pressure switch 24 is switched OFF, the routine proceeds from step S25 to step S26. Conversely when the answer to step S25 is affirmative (YES), that is, pressure switch 24 is switched ON, the routine proceeds from step S25 to step S33. The processor of ECU 33 determines, based on the state of pressure switch 24 switched OFF, that the hydraulic pressure in discharge line 16 is not satisfactorily risen. On the contrary, the processor of ECU 33 determines, based on the state of pressure switch 24 switched ON, that the hydraulic pressure in discharge line 16 is satisfactorily risen.

At step S26, a check is made to determine whether the predetermined delay period of the system-failure detection timer initialized at step S21 has expired. When the answer to step S26 is negative (NO), that is, when the predetermined delay period of the system-failure detection timer has not yet expired, the routine returns from step S26 to step S24 in order to repeatedly execute steps S24–S25. Conversely when the answer to step S26 is affirmative (YES), that is, when the delay period of the system-failure detection timer has expired, the routine advances from step S26 to step S27. When the flow from step S25 via step S26 to step S27 occurs, the processor of ECU 33 determines that there is a less amount of working fluid discharged from pump 18 in spite of electric motor 31 already energized. This is because the hydraulic pressure in discharge line 17 does not yet reach the predetermined pressure point after the predetermined elapsed time has expired with motor 31 energized. That is, steps S25–S26 and the system-failure detection timer and pressure switch 24 serve as an abnormal-condition detection means or a system-failure detection means that detects an abnormal-condition of motor 31 of electric pump 18 (or a motor/pump failure). In particular, steps S25–S26 serves as a pump-failure detection section of the processor of ECU 33 that detects a pump failure or determines that pump 18 is failed when the hydraulic pressure detected by pressure switch 24 remains at a pressure level less than the predetermined pressure point after electric motor 31 of pump 18 has been energized and thereafter the predetermined delay period (a set time of the system-failure detection timer) has expired.

At step S27, the system-failure detection timer is reset. After step S27, a series of steps S28–S32 occur.

At step S28, the duty ratio of the PWM signal applied to coil 38*b* of electromagnetic directional control valve 22 is controlled to the predetermined low duty ratio such as "0%", so as to de-energize electromagnetic directional control valve 22.

At step S29, the electric current applied to non-reversible electric motor 31 of motor-driven oil pump 18 is controlled to "0" to stop electric motor 31 of pump 18.

At step S30, an electric motor-driven pump failure indicative flag (simply, a pump failure flag) is set to "1".

At step S31, an electromagnetic-directional-control-valve (OCV) control map change from a normal-condition OCV control map (suitable to the absence of the pump failure) to an abnormal-condition OCV control map (suitable to the presence of the pump failure) occurs. Therefore, after switching to the abnormal-condition OCV control map, it is possible to keep bypass line 21 opened, and thus to return working fluid, which is flown from either one of phase-retard hydraulic chamber 9 and phase-advance hydraulic chamber 10 into induction line 17, utilizing the pulse pressure arising from alternating torque exerted on camshaft 2 and applied to the working fluid in each of hydraulic chambers 9 and 10, via bypass line 21 to discharge line 16, by continuously controlling electromagnetic directional control valve 22 based on the current engine operating condition in accordance with the abnormal-condition OCV control map. By the use of abnormal-condition OCV control map, it is possible to supply working fluid (hydraulic pressure) from induction line 17 through bypass line 21 and discharge line 16 selectively to hydraulic chambers 9 and 10, either one of which requires a hydraulic pressure rise, utilizing the pulse pressure, thus creating a phase-control assistance force by the pulse pressure without using pump 18, even in presence of the pump failure.

At step S32, ECU 33 outputs an alarm signal to the warning system (warning means) having the warning buzzer and/or instrument-cluster warning lamp 33WL, so that the warning buzzer and/or instrument-cluster warning lamp 33WL comes on in response to the alarm signal from ECU 33, and thus a visual and/or audible warning concerning the pump failure is signaled to the driver. The warning system energized (warning lamp 33WL lighting) allows the vehicle to dock for quick repairs.

Returning to step S25, when pressure switch 24 is switched ON, ECU 33 determines that electric motor-driven pump 18 is operating normally, and thus the routine flows from step S25 to step S33. After step S33, a series of steps S34–S38 occur.

At step S33, the system-failure detection timer is reset.

At step S34, electromagnetic directional control valve 22 is controlled based on the current engine operating condition (the latest up-to-date information about engine speed and/or engine load) in accordance with the normal-condition OCV control map.

At step S35, a deviation (or an error signal) of an actual angular phase of vane member 7 of phase converter 3 from a desired angular phase determined based on the current engine operating condition is calculated or computed.

At step S36, a check is made to determine whether the deviation (the error signal value) between the actual angular phase and the desired angular phase is within a predetermined dead zone. When the answer to step S36 is affirmative (YES), that is, the deviation is within the dead zone, the routine proceeds from step S36 to step S37. Conversely when the answer to step S36 is negative (NO), that is, the deviation is out of the dead zone, the routine returns from step S36 to step S35, so as to repeatedly execute steps S35–S36.

At step S37, a check is made to determine whether a drive signal of non-reversible electric motor 31 of electric motor-driven pump 18 is generated from the output interface of ECU 33, in other words, motor 31 is energized (ON). When the answer to step S37 is affirmative (YES), the routine proceeds from step S37 to step S38. Conversely when the answer to step S37 is negative (NO), the routine returns from step S37 to step S35, so as to repeatedly execute steps S35–S37.

At step S38, the system-failure detection timer is set again. After step S38, the routine returns to step S24, so as to repeatedly execute the fail-safe routine.

As discussed above in reference to the flow chart of FIG. 9, even when electric motor-driven pump 18 has been failed, it is possible to selectively supply working fluid (hydraulic pressure) to hydraulic chambers 9 and 10, either one of which requires a hydraulic pressure rise, by continuously controlling only the electromagnetic directional control valve 22 by means of ECU 33. This enables continuous executions of phase control for angular phase of camshaft 2 relative to sprocket 1, even in presence of the pump failure.

The processor of ECU 33 incorporated in the system of the embodiment is also programmed to execute engine-stall-period phase control similar to the engine-stop-period phase control routine shown in FIG. 8, so as to enhance or improve the restartability of the engine, even when a sudden engine stall takes place without turning the ignition switch OFF. Actually, the processor of ECU 33 phase-controls vane member 7 of phase converter 3 to the previously-noted engine-restart standby position by way of both of motor current control for electric motor 31 and PWM control for electric current applied to coil 38*b* of the solenoid-actuated directional control valve 22, executed simultaneously with a point of time when the engine is restarted after an engine stall has occurred.

As a modification modified from the variable valve timing control system of the embodiment, an air bleeder (or air bleeding means) may be provided in a hydraulic pressure system laid out between the hydraulically-operated phase converter 3 and electric motor-driven pump 18 (a main working-fluid (hydraulic pressure) source) in order to exhaust or extract air mixed in working fluid in the hydraulic system to the exterior space. By means of the air bleeder, it is possible to effectively exhaust or extract undesirable air, which has been mixed in working fluid in each of hydraulic chambers 9 and 10 of phase converter 3 or in the hydraulic pressure system laid out between phase converter 3 and pump 18 due to leakage of working fluid in the engine stopped state, through the air bleeder to the exterior space. As a result of this, it is possible to prevent the control accuracy of variable valve timing control of the hydraulically-operated phase converter 3 from being deteriorated owing to the air mixed. In the system of the shown embodiment, phase-converter housing 5, which is comprised of a porous housing formed of a porous sintered metal material, serves as the air bleeder (air bleeding means). In lieu thereof, the air bleeder may be provided in the hydraulic pressure system laid out between the hydraulically-operated phase converter 3 and electric motor-driven pump 18, except the phase-converter housing. In such a case, a certain portion of the hydraulic pressure system may be formed of a porous sintered structural part. By the use of the porous sintered structural part, it is possible to effectively exhaust or extract only the air mixed in working fluid in the hydraulic pressure system for phase converter 3, while preventing leakage of working fluid (oil) having a comparatively high viscosity, as much as possible. This avoids a pressure fall in working fluid delivered from pump 18 through discharge line 16 to either one of hydraulic chambers 9 and 10.

Figure 10:
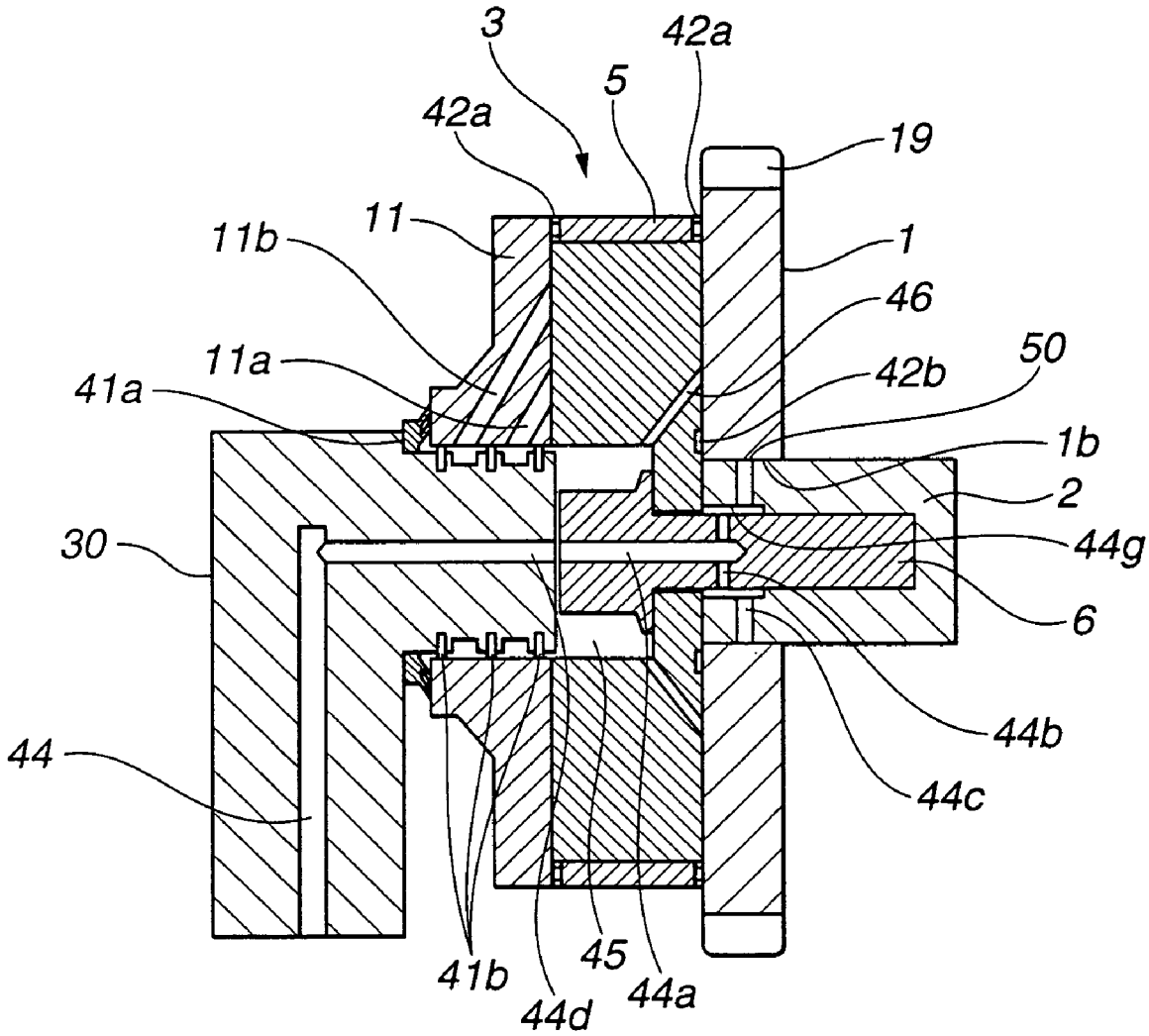
FIG. 10 is a cross-sectional view illustrating a modified automotive variable valve timing control system having a lubricating oil hole/passage.

Referring now to FIG. 10, there is shown another modification modified from the variable valve timing control system of the embodiment. In the modification shown in FIG. 10, as an oil-lubricating circuit, an axial oil hole 44*a*, first and second radial oil holes 44*b* and 44*c*, and an annular groove 44*g* are provided. More concretely, axial oil hole 44*a* is formed and bored in vane mounting bolt 6 in the axial direction of bolt 6 from the bolt head. The downstream end 44*d* of supply line 44 is communicated with axial oil hole 44*a* as well as working-fluid chamber 45. The first radial oil hole 44*b* is also formed and bored in vane mounting bolt 6 in the radial direction of bolt 6 in such a manner as to crossing axial oil hole 44*a*. The second radial oil hole 44*c* is formed and bored in the front end of camshaft 2 in the radial direction of camshaft 2. Annular groove 44*g* is formed on the inner periphery of the female screw-threaded portion of the front end of camshaft 2 into which vane mounting bolt 6 is screwed. The first and second radial oil holes 44*b* and 44*c* are communicated with each other through annular groove 44*g*. Therefore, during operation of phase converter 3, the lubricating circuit 44*a*, 44*b*, 44*c* and 44*g* permits working fluid (lubricating oil) to be supplied through the lubricating circuit (44*a*, 44*b*, 44*c*, 44*g*) to friction bearing surfaces 50 between the outer peripheral surface of the end of camshaft 2 and the inner peripheral surface of the central bore 1*b* of sprocket 1, which is rotatably supported on the camshaft end, so as to permit a constant flow of lubricating oil across the friction bearing surfaces 50.

In the shown embodiment, the hydraulically-operated phase converter 3 is constructed by hydraulically-operated vane-type timing variator. The fundamental concept of the invention can be applied to a variable valve timing control system employing a hydraulically-operated helical-gear-type timing variator. Furthermore, in the shown embodiment, the variable valve timing control system is exemplified to control a phase (intake valve open timing IVO and/or intake valve closure timing IVC) of the intake valve. In lieu thereof, the variable valve timing control system of the invention may be applied to each exhaust valve of an exhaust system so as to control a phase (exhaust valve open timing EVO and/or exhaust valve closure timing EVC) of the exhaust valve.

The entire contents of Japanese Patent Application No. 2004-149890 (filed May 20, 2004) are incorporated herein by reference.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. A variable valve timing control system of an internal combustion engine comprising:

a rotary member adapted to be driven in synchronization with rotation of an engine crankshaft, and rotatably supported on a camshaft to permit relative rotation of the camshaft to the rotary member;

a hydraulically-operated phase converter disposed between the rotary member and the camshaft, and having a phase-advance hydraulic chamber and a phase-retard hydraulic chamber for changing an angular phase of the camshaft relative to the rotary member;

an electric pump that supplies working fluid to the phase-advance hydraulic chamber and the phase-retard hydraulic chamber through a phase-advance hydraulic line connected to the phase-advance hydraulic chamber and a phase-retard hydraulic line connected to the phase-retard hydraulic chamber;

a directional control valve disposed between a first pair of fluid lines including a discharge line and an induction line of the pump and a second pair of fluid lines including the phase-advance hydraulic line and the phase-retard hydraulic line, for determining a path through which the working fluid is directed from the discharge line to a first one of the phase-advance hydraulic line and the phase-retard hydraulic line and simultaneously determining a path through which the working fluid is directed from the second one of the phase-advance hydraulic line and the phase-retard hydraulic line to the induction line;

a control unit configured to be electronically connected to at least the directional control valve, for controlling the directional control valve depending on an engine operating condition;

a check valve disposed in the discharge line for permitting flow in a direction that the working fluid flows from the pump to the directional control valve and preventing any flow in the opposite direction; and a supplementary pump operable independently of the electric pump for supplying moving engine parts with working fluid for lubrication and supplying the working fluid through a working-fluid passage to the phase-advance hydraulic chamber and the phase-retard hydraulic chamber of the phase converter, wherein the phase converter comprises an air bleeder for forcibly exhausting air mixed in the working fluid in the phase converter to an exterior space by supplying the working fluid pressurized by the supplementary pump to the phase-advance hydraulic chamber and the phase-retard hydraulic chamber of the phase converter.

2. A variable valve timing control system of an internal combustion engine comprising:

a rotary member adapted to be driven in synchronization with rotation of an engine crankshaft, and rotatably supported on a camshaft to permit relative rotation of the camshaft to the rotary member;

a hydraulically-operated phase converter disposed between the rotary member and the camshaft, and having a phase-advance hydraulic chamber and a phase-retard hydraulic chamber for changing an angular phase of the camshaft relative to the rotary member;

an electric pump that supplies working fluid to the phase-advance hydraulic chamber and the phase-retard hydraulic chamber through a phase-advance hydraulic line connected to the phase-advance hydraulic chamber and a phase-retard hydraulic line connected to the phase-retard hydraulic chamber;

a directional control valve disposed between a first pair of fluid lines including a discharge line and an induction line of the pump and a second pair of fluid lines including the phase-advance hydraulic line and the phase-retard hydraulic line, for determining a path through which the working fluid is directed from the discharge line to a first one of the phase-advance hydraulic line and the phase-retard hydraulic line and simultaneously determining a path through which the working fluid is directed from the second one of the phase-advance hydraulic line and the phase-retard hydraulic line to the induction line;

a control unit configured to be electronically connected to at least the directional control valve, for controlling the directional control valve depending on an engine operating condition;

a check valve disposed in the discharge line for permitting flow in a direction that the working fluid flows from the pump to the directional control valve and preventing any flow in the opposite direction; and at least one of the discharge line and the induction line comprising a substantially L-shaped fluid-line portion formed by a vertically-extending oil line segment and a horizontally-extending oil line segment, and a contaminant-capturing bore vertically extending downwards in a direction of acceleration of gravity from the substantially L-shaped fluid-line portion.

3. A variable valve timing control system of an internal combustion engine comprising:

a rotary member adapted to be driven in synchronization with rotation of an engine crankshaft, and rotatably supported on a camshaft to permit relative rotation of the camshaft to the rotary member;

a hydraulically-operated phase converter disposed between the rotary member and the camshaft, and having a phase-advance hydraulic chamber and a phase-retard hydraulic chamber for changing an angular phase of the camshaft relative to the rotary member;

an electric pump that supplies working fluid to the phase-advance hydraulic chamber and the phase-retard hydraulic chamber through a phase-advance hydraulic line connected to the phase-advance hydraulic chamber and a phase-retard hydraulic line connected to the phase-retard hydraulic chamber;

a directional control valve disposed between a first pair of fluid lines including a discharge line and an induction line of the pump and a second pair of fluid lines including the phase-advance hydraulic line and the phase-retard hydraulic line, for determining a path through which the working fluid is directed from the discharge line to a first one of the phase-advance hydraulic line and the phase-retard hydraulic line and simultaneously determining a path through which the working fluid is directed from the second one of the phase-advance hydraulic line and the phase-retard hydraulic line to the induction line;

a control unit configured to be electronically connected to at least the directional control valve, for controlling the directional control valve depending on an engine operating condition;

a check valve disposed in the discharge line for permitting flow in a direction that the working fluid flows from the pump to the directional control valve and preventing any flow in the opposite direction; and the control unit being configured to be electronically connected to the pump, for driving the pump depending on the engine operating condition; and the control unit executing an engine-stop-period phase control during a time period from a time when an ignition switch has been turned OFF to a time when an engine stopped state has been completed, for controlling the phase converter to a predetermined engine-restart standby position substantially corresponding to a valve timing, which is preprogrammed to be suitable for an engine restarting period, by driving the pump.

4. A variable valve timing control system of an internal combustion engine comprising:

a rotary member adapted to be driven in synchronization with rotation of an engine crankshaft, and rotatably supported on a camshaft to permit relative rotation of the camshaft to the rotary member;

a hydraulically-operated phase converter disposed between the rotary member and the camshaft, and having a phase-advance hydraulic chamber and a phase-retard hydraulic chamber for changing an angular phase of the camshaft relative to the rotary member;

an electric pump that supplies working fluid to the phase-advance hydraulic chamber and the phase-retard hydraulic chamber through a phase-advance hydraulic line connected to the phase-advance hydraulic chamber and a phase-retard hydraulic line connected to the phase-retard hydraulic chamber;

a directional control valve disposed between a first pair of fluid lines including a discharge line and an induction line of the pump and a second pair of fluid lines including the phase-advance hydraulic line and the phase-retard hydraulic line, for determining a path through which the working fluid is directed from the discharge line to a first one of the phase-advance hydraulic line and the phase-retard hydraulic line and simultaneously determining a path through which the working fluid is directed from the second one of the phase-advance hydraulic line and the phase-retard hydraulic line to the induction line;

a control unit configured to be electronically connected to at least the directional control valve, for controlling the directional control valve depending on an engine operating conditions;

a check valve disposed in the discharge line for permitting flow in a direction that the working fluid flows from the pump to the directional control valve and preventing any flow in the opposite direction; and the control unit being configured to be electronically connected to the pump, for driving the pump depending on the engine operating condition; and the control unit executing an engine-stall-period phase control when restarting the engine after an engine stall occurs without turning an ignition switch OFF, for controlling the phase converter to a predetermined engine-restart standby position substantially corresponding to a valve timing, which is preprogrammed to be suitable for an engine restarting period, by driving the pump.

5. A variable valve timing control system of an internal combustion engine comprising:

a rotary member adapted to be driven in synchronization with rotation of an engine crankshaft, and rotatably supported on a camshaft to permit relative rotation of the camshaft to the rotary member;

a hydraulically-operated phase converter disposed between the rotary member and the camshaft, and having a phase-advance hydraulic chamber and a phase-retard hydraulic chamber for changing an angular phase of the camshaft relative to the rotary member;

an electric pump that supplies working fluid to the phase-advance hydraulic chamber and the phase-retard hydraulic chamber through a phase-advance hydraulic line connected to the phase-advance hydraulic chamber and a phase-retard hydraulic line connected to the phase-retard hydraulic chamber;

an electromagnetic solenoid-operated directional control valve disposed between a first pair of fluid lines including a discharge line and an induction line of the pump and a second pair of fluid lines including the phase-advance hydraulic line and the phase-retard hydraulic line, for determining a path through which the working fluid is directed from the discharge line to a first one of the phase-advance hydraulic line and the phase-retard hydraulic line and simultaneously determining a path through which the working fluid is directed from the second one of the phase-advance hydraulic line and the phase-retard hydraulic line to the induction line;

a bypass line intercommunicating the discharge line and the induction line;

a control unit configured to be electronically connected to at least the solenoid-operated directional control valve, for controlling the solenoid-operated directional control valve depending on an engine operating condition;

the control unit comprising a pump-failure detection section that detects a failure in the pump; and the control unit executes a fail-safe operating mode when the failure in the pump is detected by the pump-failure detection section, for creating a phase-control assistance force needed to supply the working fluid through the bypass line selectively to either one of the phase-advance hydraulic chamber and the phase-retard hydraulic chamber by a pulse pressure arising from alternating torque exerted on the camshaft, by controlling the solenoid-operated directional control valve without using the pump.

6. The variable valve timing control system as claimed in claim 5, further comprising:

a pressure detector provided in the discharge line for detecting a change in hydraulic pressure in the discharge line, wherein the pump-failure detection section of the control unit determines that the pump has failed when the hydraulic pressure detected by the pressure detector remains at a pressure level less than a predetermined pressure point after an electric motor of the pump has been energized and thereafter a predetermined delay period has expired.

7. The variable valve timing control system as claimed in claim 5, further comprising:

a warning system that warns of the failure in the pump after the failure in the pump has been detected by the pump-failure detection section.

* * * * *